US008573024B2

(12) United States Patent
Lanksweirt

(10) Patent No.: US 8,573,024 B2
(45) Date of Patent: Nov. 5, 2013

(54) WEDGE DRIVE

(75) Inventor: Jochen Lanksweirt, Heidenheim (DE)

(73) Assignee: voestalpine Giesserei Linz GmbH, Linz (AT)

( * ) Notice: Subject to any disclaimer, the term of this patent is extended or adjusted under 35 U.S.C. 154(b) by 310 days.

(21) Appl. No.: 13/139,197

(22) PCT Filed: Dec. 9, 2009

(86) PCT No.: PCT/EP2009/066704
§ 371 (c)(1),
(2), (4) Date: Jul. 1, 2011

(87) PCT Pub. No.: WO2010/066776
PCT Pub. Date: Jun. 17, 2010

(65) Prior Publication Data

US 2011/0252905 A1 Oct. 20, 2011

(30) Foreign Application Priority Data

Dec. 10, 2008 (DE) ..... 10 2008 061 420

(51) Int. Cl.
*B21D 5/04* (2006.01)
*B26D 5/18* (2006.01)

(52) U.S. Cl.
USPC ..... 72/452.9; 83/627; 83/635

(58) Field of Classification Search
USPC ..... 72/304, 315, 389.4, 452.9, 481.1, 72/481.3; 83/627, 635
See application file for complete search history.

(56) References Cited

U.S. PATENT DOCUMENTS

| | | | | |
|---|---|---|---|---|
| 5,101,705 | A | 4/1992 | Matsuoka | |
| 5,884,521 | A * | 3/1999 | Fidziukiewicz | 72/452.9 |
| 5,904,064 | A * | 5/1999 | Higuchi | 72/452.9 |
| 6,164,115 | A * | 12/2000 | Higuchi et al. | 72/452.9 |
| 6,990,844 | B1 | 1/2006 | Fidziukiewicz | |
| 7,043,956 | B2 * | 5/2006 | Higuchi et al. | 72/452.9 |
| 7,114,364 | B2 * | 10/2006 | Weigelt | 72/452.9 |
| 7,191,635 | B2 * | 3/2007 | Chun et al. | 72/452.9 |
| 7,337,649 | B2 * | 3/2008 | Fidziukiewicz | 72/452.9 |

FOREIGN PATENT DOCUMENTS

| | | |
|---|---|---|
| DE | 2329324 | 12/1974 |
| DE | 2439217 | 3/1976 |
| DE | 2640318 | 3/1978 |
| DE | 19753549 C2 | 2/2000 |
| DE | 102006036654 A1 | 2/2008 |
| EP | 1197319 A1 | 4/2002 |
| JP | 2003080326 | 3/2003 |

* cited by examiner

*Primary Examiner* — David B Jones
(74) *Attorney, Agent, or Firm* — Setter Roche LLP

(57) ABSTRACT

The invention relates to a wedge drive for converting a vertical pressing force, including at least one slider bed, one slider wedge, and one driver; to provide a movable coupling of the slider wedge in the slider bed, at least one bearing lug is provided; the bearing lug reaches through at least one bearing opening in a side wall of the slider bed from the outside and engages in a recess in the slider wedge; the slider wedge is supported on the bearing lug and the bearing lug is supported on a wall delimiting the bearing opening.

6 Claims, 23 Drawing Sheets

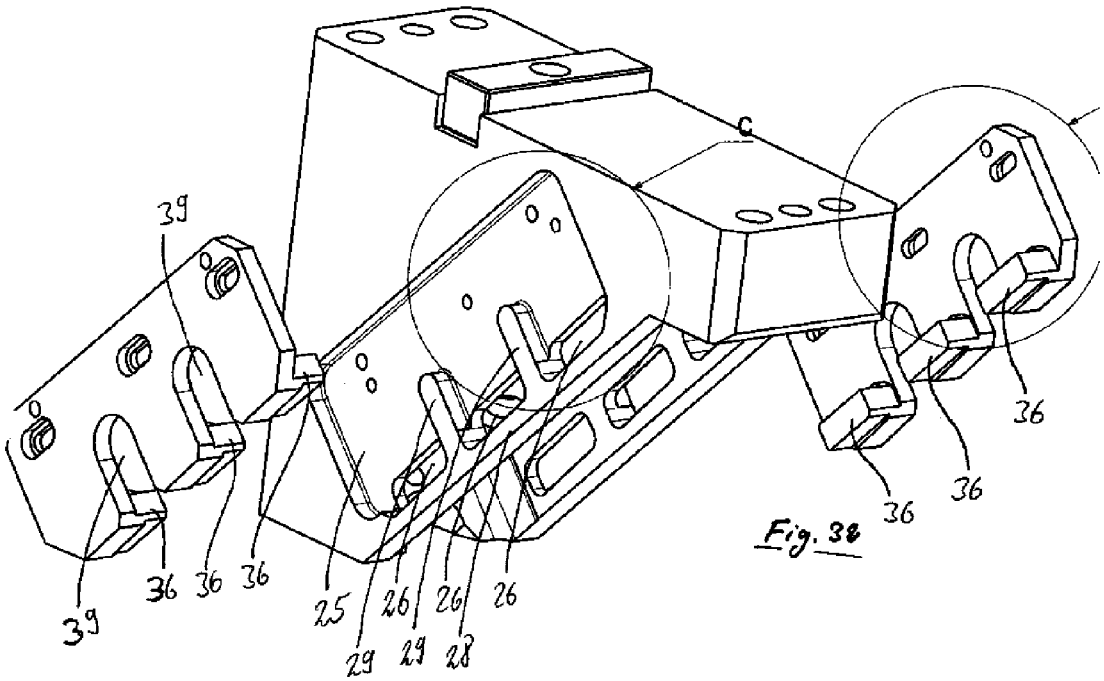
Fig. 38
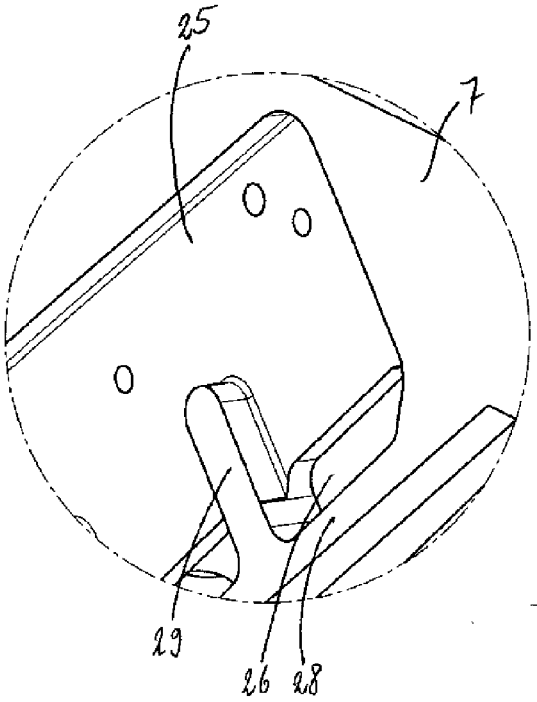
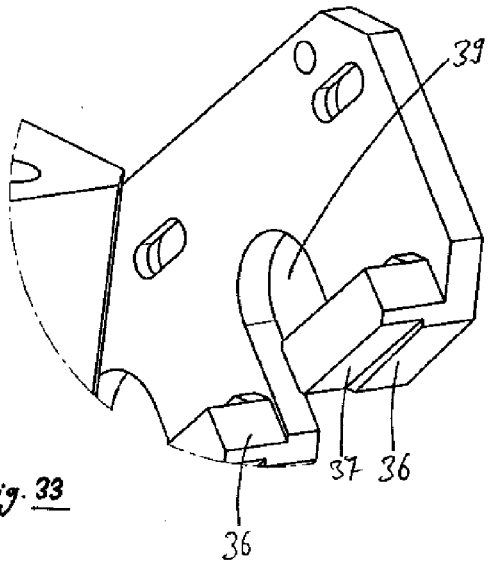
Fig. 33

WEDGE DRIVE

FIELD OF THE INVENTION

The invention relates to a wedge drive.

BACKGROUND OF THE INVENTION

Wedge drives are used in tools in metalworking, e.g. in presses. These wedge drives are usually connected to the devices that perform a stamping or other deformation procedure. A conventional wedge drive has an upper guide part, which includes a slider element and a slider guide element, and a lower guide part, which includes a driver element or vice versa. On the slider guide element side, the wedge drives are moved by a drive unit that exerts a generally vertical pressing force. On the driver element side, wedge drives are fastened to a base plate in the tool or press, onto which plate the work piece to be machined is also placed, either directly or by means of a corresponding support device.

DE 26 40 318 B2 has disclosed a wedge drive for redirecting a vertical pressing force into a force acting at an angle thereto for the forming process. This wedge drive is composed of a drive wedge on which a vertical force of a corresponding work press acts and a slider wedge, which transmits the force in the horizontal direction. The driver wedge and the slider wedge travel either over a rounded cooperating region or in another embodiment, over a roller.

DE 24 39 217 A1 has disclosed a wedge press with a prism-shaped wedge guide in which the contact surfaces are roof-shaped or trough-shaped and the roof or trough extends over the entire pressure-absorbing width of the wedge.

DE 23 29 324 B2 has disclosed a wedge press with a device for preventing unwanted movements of the wedge, which is equipped with a prism-shaped wedge guide.

Usually, overhead suspension wedge drives used in the auto body industry are composed of a driver, a slider, and a slider receptacle. The top of the slider receptacle is acted on by a vertical force that pushes the slider receptacle downward. The driver is firmly anchored in the tool, so that when pressure is exerted on the slider receptacle, the slider anchored in the slider receptacle is pushed in a freely selectable direction other than the vertical working direction.

Overhead suspension wedge drives are used frequently. With this design, the slider is suspended in its guide so that it is able to move in the slider receptacle. The driver is rigidly supported in the lower part and predetermines the working direction of the slider. With the downward stroke of the press, the slider, whose spring suspension has bottomed out, comes to rest on the driver and is pushed by the slider receptacle, which continues to move, across the driver surface in the working direction.

The wedge drives known from this prior art have disadvantages: the sliders used often have only short service lives and due to their structural design, are subject to a large amount of wear and tear. They must therefore be replaced often, even after short operating times, because the wear on them makes it impossible to continue redirecting the vertical pressing forces in a precise fashion, resulting in unacceptable tolerances for metal machining.

DE 197 53 549 C2 has disclosed a wedge drive that can be manufactured in a continuous industrial manufacturing process and should have a long service life. To guide the slider in the slider receptacle, angle bars are provided, which are made of bronze and which have glide elements made of graphite mounted in the angle bar. To redirect a vertical pressing force, this wedge drive is generally equipped with a driver, a slider, and a slider receptacle; the driver has a prism-shaped guide and the travel path of the slider on the driver is shorter than the travel path of the slider on the slider receptacle and the ratio of the travel paths to each other is at least 1 to 1.5 and the angle $\alpha$ between the travel paths is 50° to 70°. With a slider of this kind, the driver element has a prism-shaped surface, with the flanks of the prism-shaped surface embodied to slope downward toward the outside. This wedge drive also has forced return brackets on two opposite sides in the respective grooves of the slider element and driver element. If a spring element for returning the slider element breaks, these forced return brackets ensure that the slider element returns to its starting position, thus preventing screw-mounted stamped elements from being torn out. The slider element is fastened to the slider guide element by means of the angle bars and mounting screws and can be moved along the angle bars relative to the slider guide element.

U.S. Pat. No. 5,101,705 has disclosed another wedge drive in which the slider element is suspended on angle bars and is attached to the slider guide element by means of them. In this case, the plates that rest against each other and the elements required for fastening must be precisely ground to guarantee the required running clearance between the slider element and slider guide element. In this wedge drive and also the other known wedge drives in which the slider guide element and slider element are connected to each other by means of angle bars and screws, it is disadvantageous that all tensile forces are introduced into the screws, which particularly at the moment that an expansion of the screws and material surrounding them occurs, negatively affects the running clearance of the slider guide elements and slider elements, which move relative to each other. This then results in a reduced rigidity because there is a significant increase in wear due to the distortion of the tool in this region. In addition, it turns out to be disadvantageous that the slider element cannot expand laterally when heated since it is constricted in this respect by the angle bars. This can also lead to an increased wear on the tool.

EP 1 197 319 has disclosed a wedge drive in which the slider element and slider guide element are held together by means of guide brackets. This should render it unnecessary for additional angle bars or other devices connecting the two elements to be precisely ground in order to guarantee a required running clearance. Also, there is no adverse effect on the running clearance even with heating of the wedge drive and tool, because the connection by means of a guide bracket is able to absorb not only resulting expansions of the material but also production tolerances. There is thus also no longer any adverse effect on or reduction of the rigidity of the wedge drive. A high degree of running precision can be achieved despite the elimination of a grinding step. The guide brackets here engage with the slider guide element in a form-locked fashion; because of this form-locked engagement, the slider element is suspended on the slider guide element by means of the guide brackets. It is therefore not necessary for them to be secured to the slider guide element by means of screws that are on the one hand, susceptible to wear and on the other hand, can cause the above-mentioned adverse effect on the running clearance in the presence of heat.

The object of the invention is to create a wedge drive in which the amount of bronze material used is reduced, in which the force transfer region is optimized, and which has a more stable slider bed region.

SUMMARY OF THE INVENTION

According to the invention, the wedge drive is composed of three main parts, namely a driver, the slider and the slider guide. These are accompanied by the usual accessories such as a forced return device, glide plates, and a spring, in particular a gas compression spring. The gas compression spring moves the slider back into the starting position when the press is raised; if the gas compression spring fails, the forced return device returns the slider to the starting position. The glide plates do not in fact have a vital task to perform for the function of the slider, but they do reduce the wear and can be simply and quickly replaced when worn. In addition, a so-called "lock-out" system is provided, which immobilizes the slider in the BDC position, i.e. the bottom dead center position of the slider.

According to the invention, instead of a bracket that connects the top and bottom parts of the slider to each other, a so-called connector strip is used, which reaches through openings in the slider bed side walls to engage the slider and hold it in the slider bed. As a result, the force transfer region is optimal, i.e., the force introduction points are much less far apart than in the case of a form-locked engagement with guide brackets, enabling narrower tolerances and also reducing changes to tolerances caused by thermal expansion. Because of the more advantageous design, the slider bed is more stable and it is possible to reduce costs.

The connector strip according to the invention connects the slider bed to the slider by means of form-locked engagement; the connector strip is fastened to the slider bed by means of screws. These screws are not subjected to any stress or what little stress they are subjected to is so slight as to be insignificant.

The invention will be explained below by way of example in conjunction with the drawings.

BRIEF DESCRIPTION OF THE DRAWINGS

FIG. 32 shows the wedge drive from FIG. 25 in a perspective exploded view of the slider bed and the connector strips.

FIG. 33 shows two enlarged details from FIG. 32.

DETAILED DESCRIPTION OF THE PREFERRED EMBODIMENTS

Figure 1:
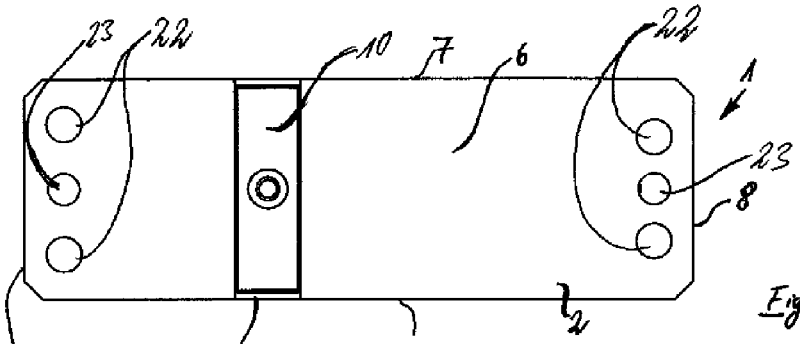
FIG. 1 is a top view of a first embodiment of the wedge drive according to the invention.
Figure 2:
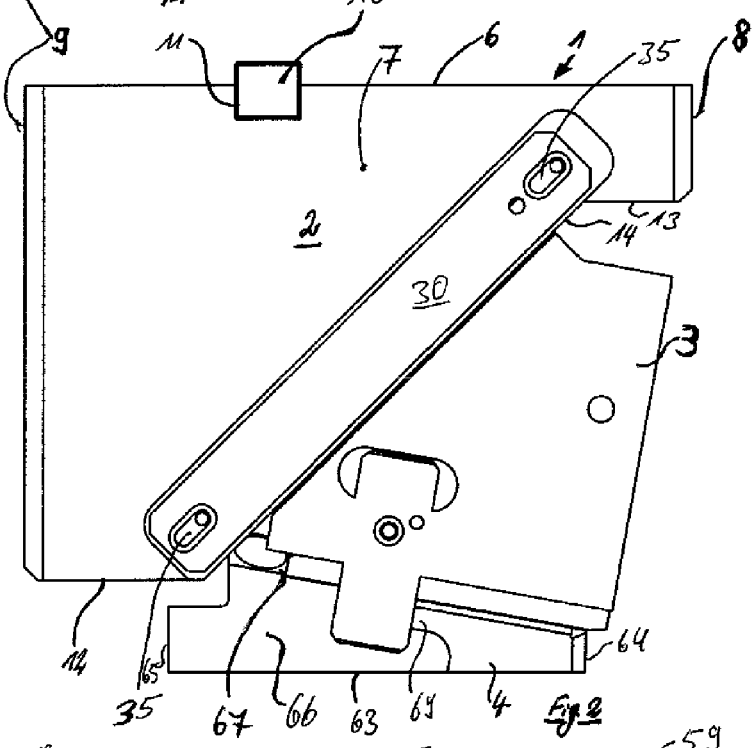
FIG. 2 is a side view of the wedge drive.
Figure 3:
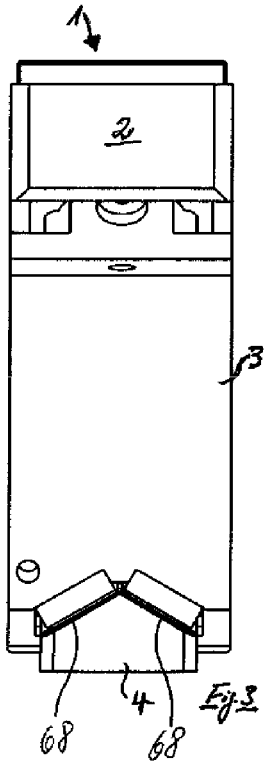
FIG. 3 is a front view of the wedge drive.
Figure 4:
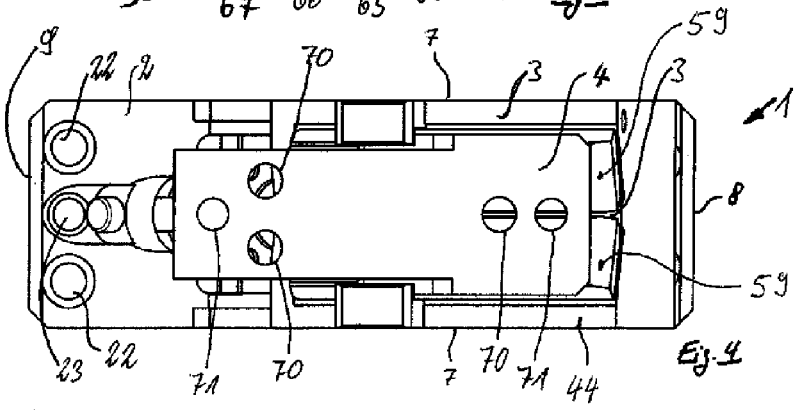
FIG. 4 is a bottom view of the wedge drive.
Figure 5:
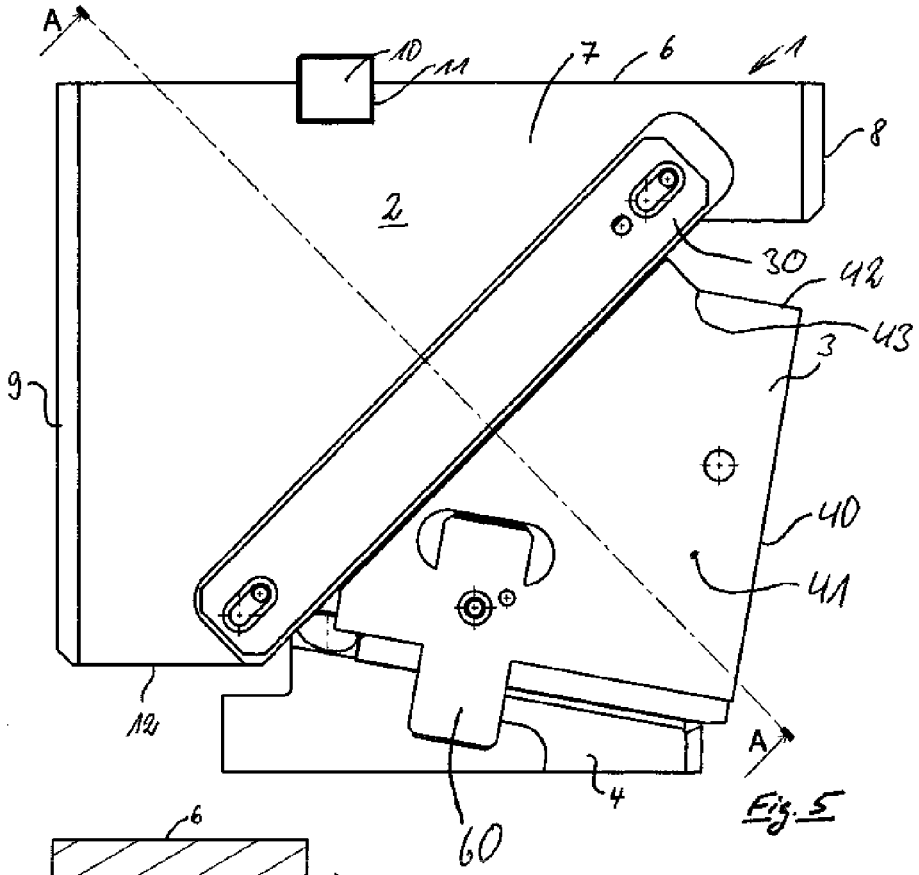
FIG. 5 is a side view of the wedge drive, with a sectional plane indicated.
Figure 6:
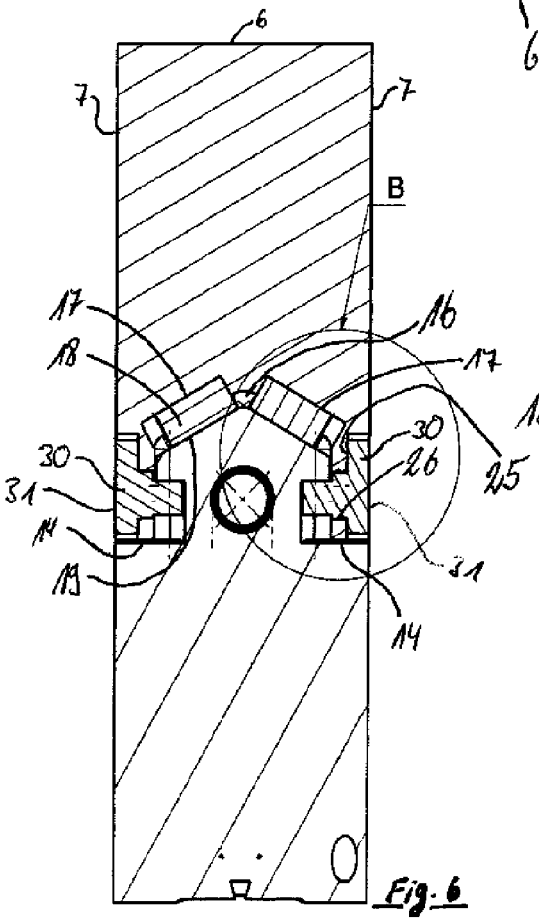
FIG. 6 shows a cross-section through the wedge drive in FIG. 5 along the sectional plane A-A.
Figure 7:
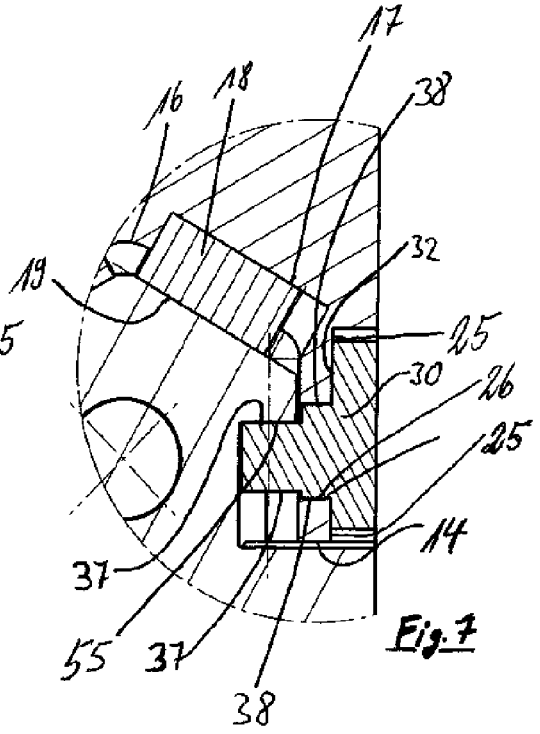
FIG. 7 shows an enlarged detail from FIG. 6.
Figure 8:
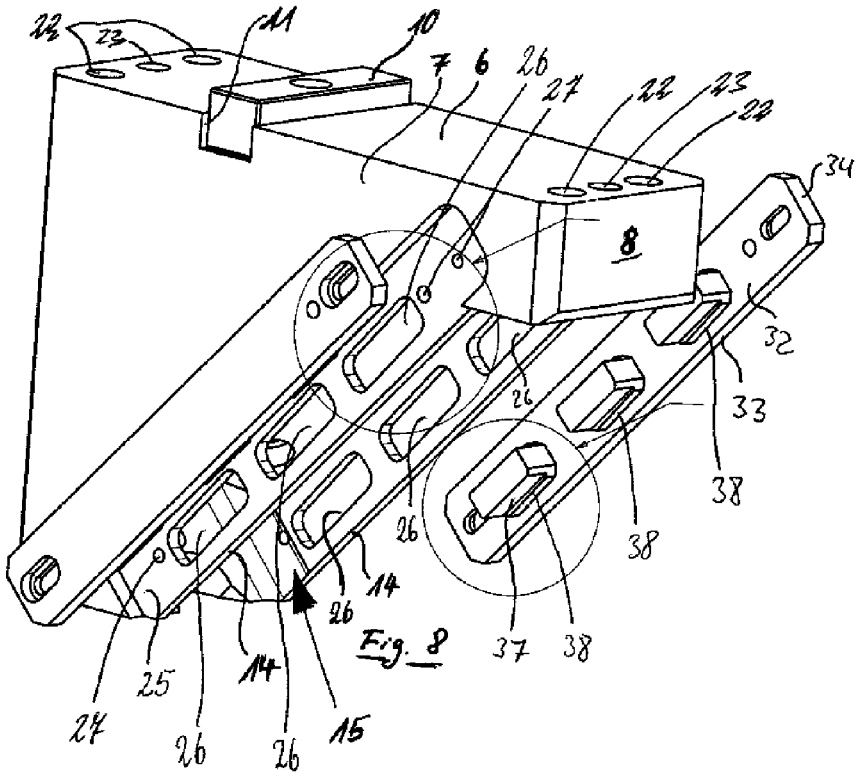
FIG. 8 is an exploded view of the slider bed and the associated connector strips.
Figure 9:
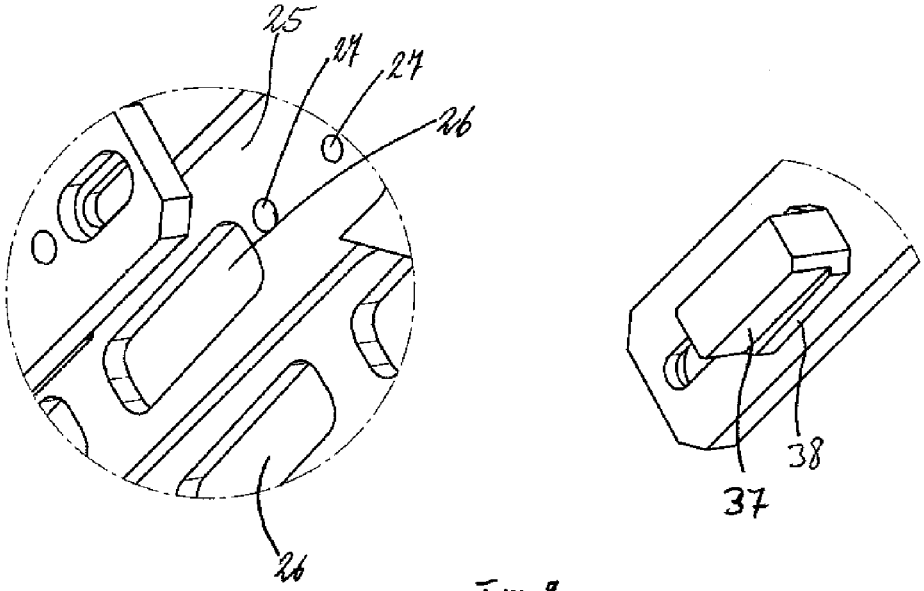
FIG. 9 shows an enlarged detail from FIG. 8.
Figure 10:
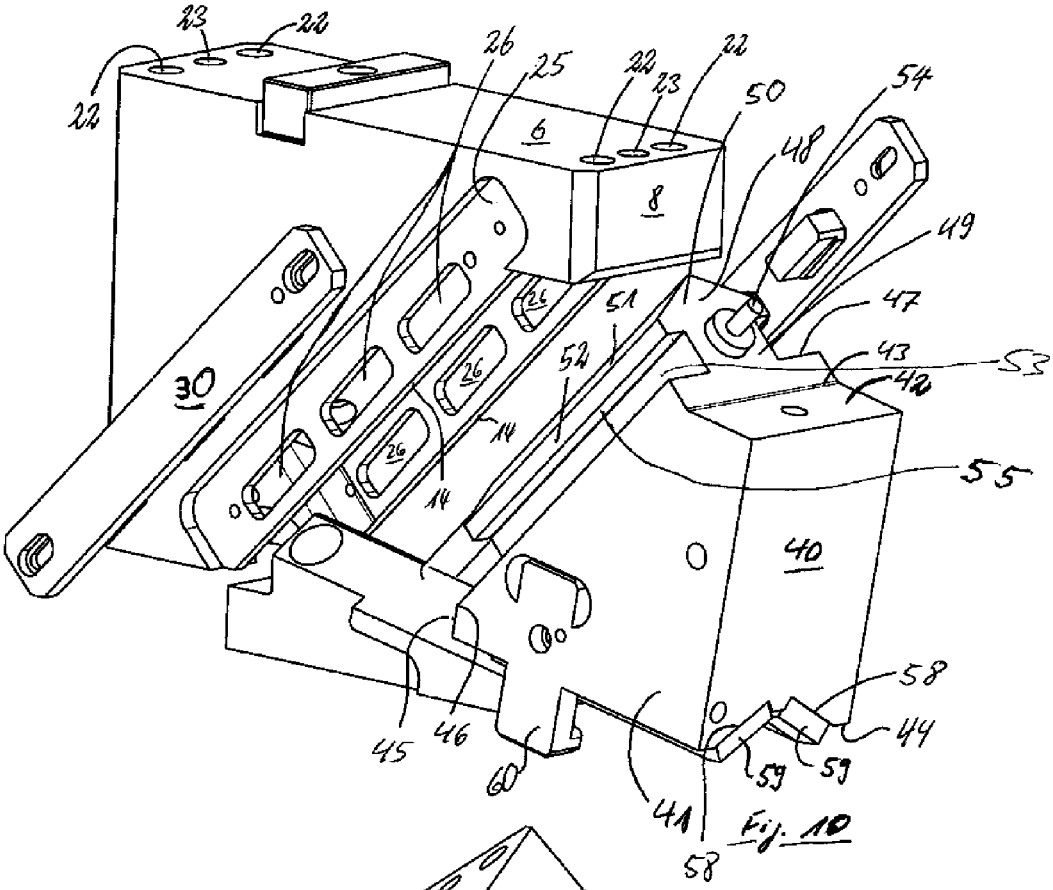
FIG. 10 is a perspective exploded view of the slider, the driver, the slider bed, and the connector strips.
Figure 11:
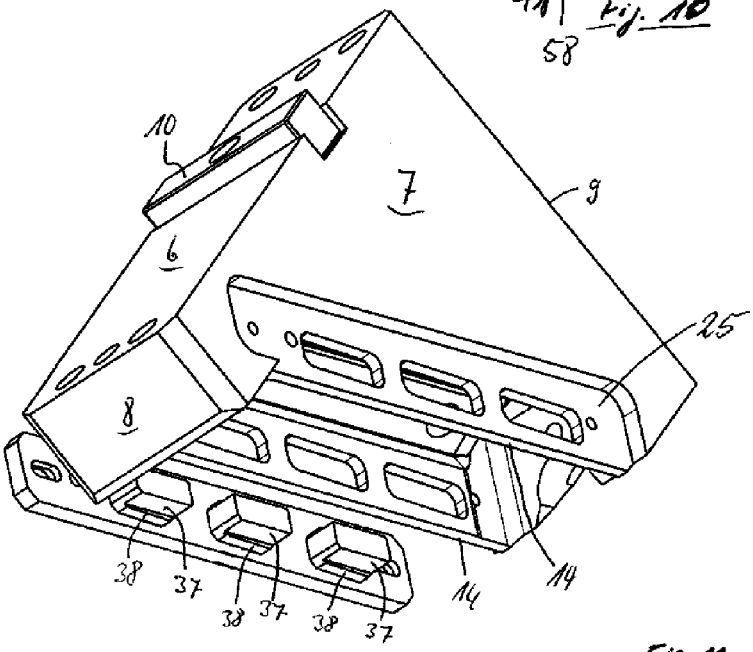
FIG. 11 is another exploded view of the slider bed and a connector strip.
Figure 12:
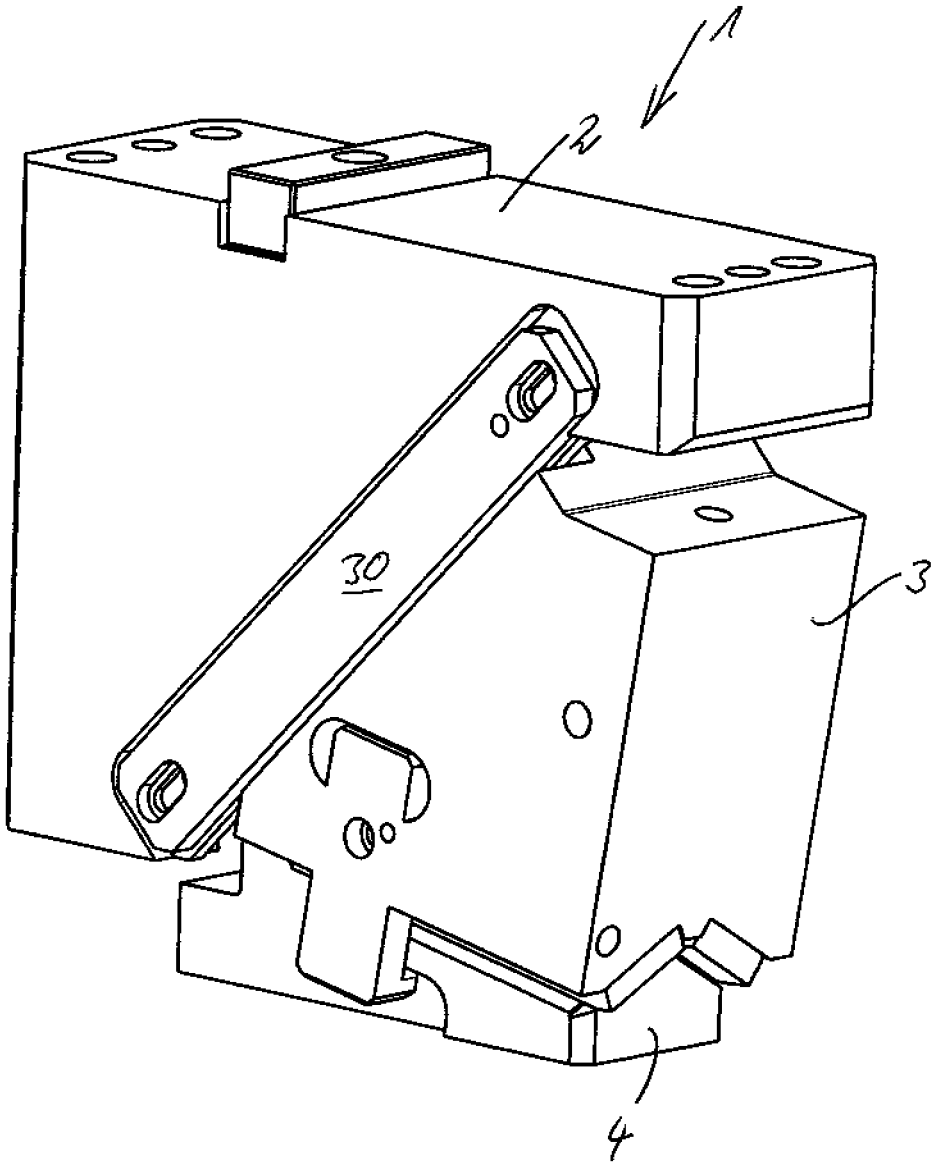
FIG. 12 is a perspective side view of the wedge drive.
Figure 13:
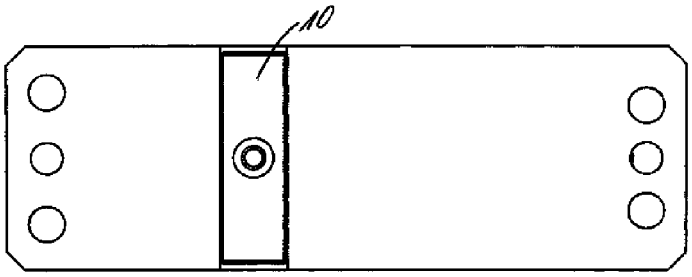
FIG. 13 is a top view of another embodiment of the wedge drive according to the invention.
Figure 14:
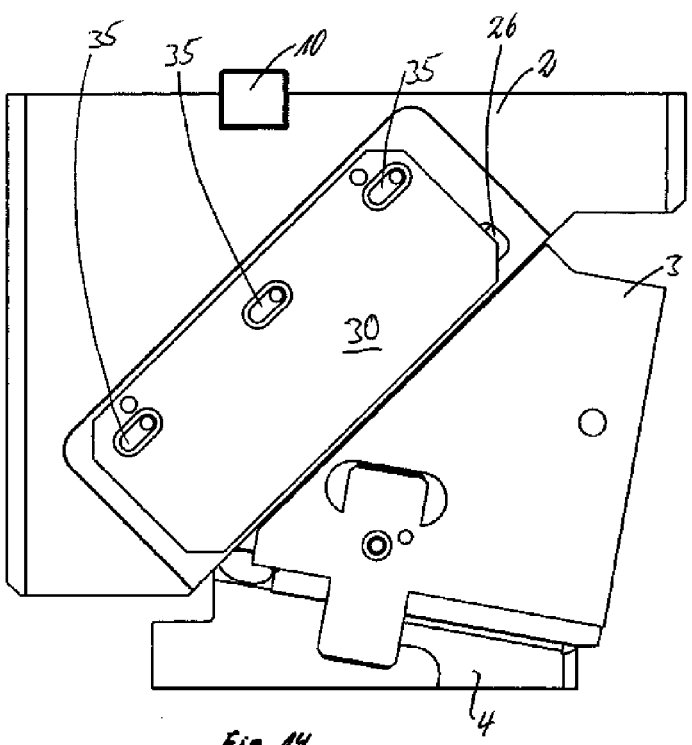
FIG. 14 is a side view of the wedge drive from FIG. 13.
Figure 15:
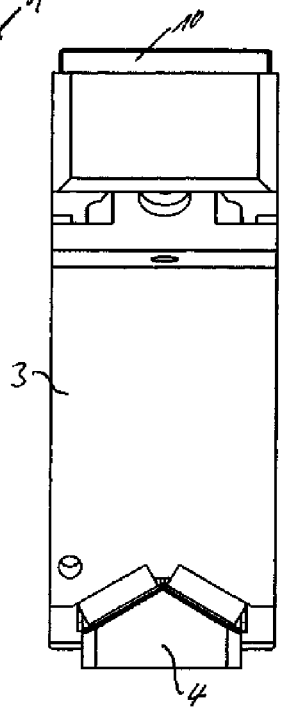
FIG. 15 is a front view of the wedge drive from FIG. 13.
Figure 16:
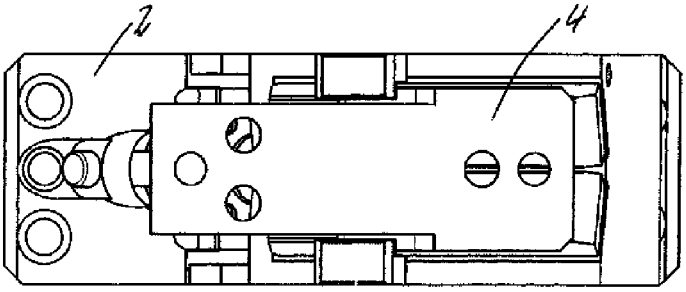
FIG. 16 is a bottom view of the wedge drive from FIG. 13.
Figure 17:
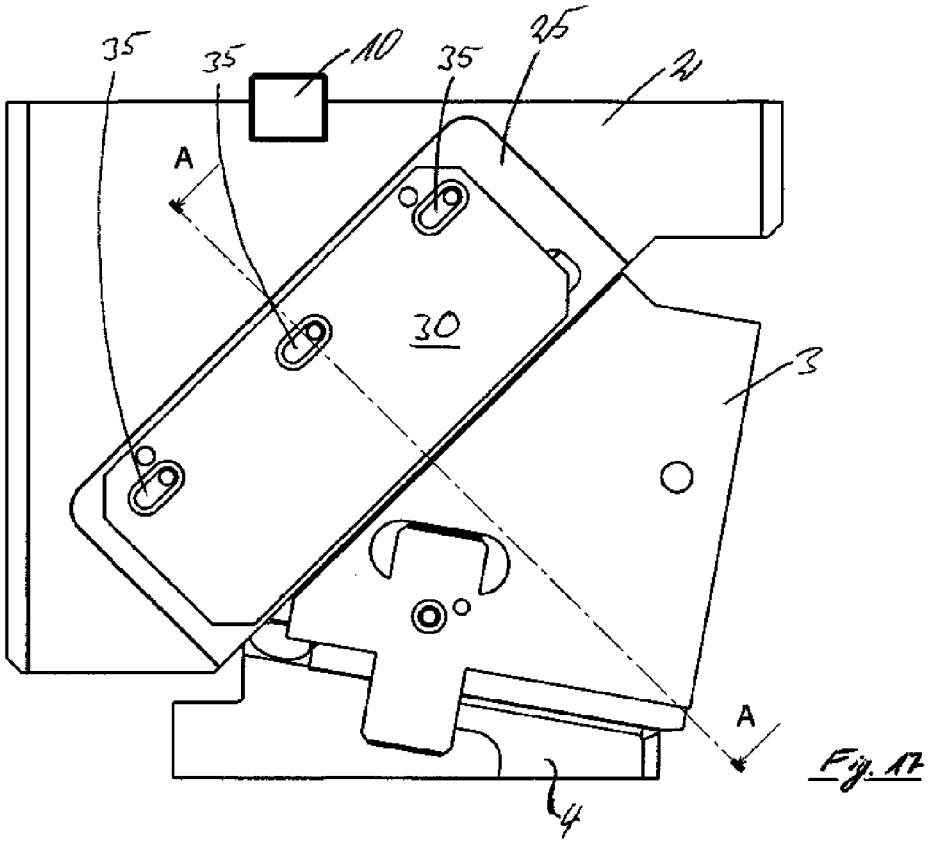
FIG. 17 is a side view of the wedge drive from FIG. 13, with a sectional plane indicated.

A wedge drive 1 according to the invention has a slider bed 2, a slider wedge 3, and a driver 4 as main components.

The slider bed 2 is box-shaped component with a top wall 6, side walls 7 extending orthogonally from it, a front end wall 8, and a back wall 9. The end wall 8 and the back wall 9 extend parallel to each other and orthogonal to the top wall 6 while the side walls 7 extend perpendicular or orthogonal to the top wall 6 and to the end wall 9 and back wall 9.

In the top wall 6, a feather key 10, which is for fitting the slider bed into a tool, is provided, which is embodied in the form of an elongated rectangle and is situated in a corresponding keyway 11 in the top wall 6.

Parallel to the top wall 6 and at a right angle to the side walls 7 and back wall 9, a bottom wall 12 extends away from an edge that it shares with the back wall 9.

Parallel to the back wall 9, the front end wall 8 extends from the top wall 6 for approximately ¼ the length of the back wall 9. Parallel to the top wall 6 and perpendicular to the side walls 7, a front end bottom wall 13 extends toward the back wall 9 from the front end wall 8 for approximately ⅙ the length of the top wall. The edge of the bottom 12 oriented away from the back wall 9 and the edge of the front end bottom wall 13 oriented away from the front end wall 8 are connected by free edges 14 of the side walls 7 extending diagonally relative to the top 6.

In the region of the free longitudinal edges of the side walls 7 between the walls 12, 13, an opening 15 extends into the slider bed 2. The opening extends a short distance parallel to the side walls 7 and ends with a roof-shaped surface 16.

Elongated rectangular channels 17 are provided in the roof-shaped surface 16. Glide elements 18 that are likewise elongated and rectangular, are mounted in the channels 17 and each have a respective glide surface 19 protruding from the channels 17 and roof-shaped surface 16.

The top wall 6 of the slider bed 2 is provided with a set of three holes adjacent to the front end wall 8 and another set adjacent to back wall 9; the two series of holes are situated adjacent and parallel to the front end wall 8 and back wall 9, respectively, and extend all the way through, orthogonal to the top 6. The outer holes 22 serve as screw holes for fastening the slider bed 2 to a top part of a tool while the middle holes 23 are dowel holes that are used in an intrinsically known way.

Adjacent to the free longitudinal edges 14 of the side walls 7, flat channels 25 are provided, which extend into the side wall 7 to a depth of approximately half the thickness of the side wall 7 in the vicinity of the opening. These channels are elongated and rectangular; they extend a short distance beyond the free longitudinal edges 14 in the vicinity of the lower wall 12 and extend a short distance beyond the free longitudinal edges 14 in the vicinity of the front end bottom wall 13.

Three bearing openings 26 are provided along the longitudinal center of the channel 25; they are elongated and rectangular with rounded corners and a longitudinal span extending along the length of the channel 25. Mounting holes 27 are also provided in the region of the channel bottom, situated at diametrically opposite ends of the series of bearing openings 26.

The channels 25 and the bearing openings 26 are provided to accommodate connector strips 30, whose function will be explained later.

The connector strip 30 is an elongated plate-shaped element with an outer surface 31, an inner surface 32, longitudinal edges 33, and end edges 34.

The connector strip 30 here has a length, which is slightly less than the length of the channel 25, and in the region of the end edges 34 and approximately adjacent to them, has an oblong hole 35 extending along the longitudinal midline through which the connector strip 30 is screw-mounted to the mounting holes 27 so that it is able to move longitudinally in the channel 25.

On the inside 32 of the connector strip 30, bearing lugs 36 are arranged one after the other in the longitudinal direction. The bearing lugs are box-shaped or block-shaped elements with a width at the base, which approximately corresponds to or is slightly less than the width of the bearing openings 26, and a length in the longitudinal direction of the connector strips 30, which is less than the length of the bearing openings 26 in order to ensure a longitudinal mobility. Spaced apart from the inner surface 32, the bearing lugs 36 have a bevel 37 on each broad side; the bevels 37 are oriented in the same direction as each other, i.e., extend parallel to each other. Adjacent to the inner surface 32, the bearing lugs 36 are thus left with a base area whose height corresponds approximately to the thickness of the side wall 7 in the region of the channel 25 to accommodate the bearing lugs. A longitudinal edge 38 oriented toward the free longitudinal edge 14 in the inserted position of the connector strip, together with a longitudinal edge of the opening 26 oriented toward the bearing lug 36 constitutes a first bearing. The bevel 37 oriented away from the longitudinal edge 38 constitutes a bearing for the slider wedge 3 that will be described below.

In the mounted state, the connector strip 30 rests with its inner surface 32 against the channel bottom of the channel 25; the bearing lugs 36 extend through the openings 26 and their regions equipped with the bevels 37 protrude inward beyond the side wall 7, into the opening.

The slider wedge 3 is also a box-shaped component with a width that approximately corresponds to the width of the slider bed 2. The slider wedge 3 has a back wall 40 and perpendicular to it, side walls 41 extending away from the back wall 40. In addition, the slider wedge 3 has a narrow top wall 42 connecting the back wall 40 and the side walls 41. The top wall 42 extends a short distance perpendicular to the back wall 40 and then extends upward a short distance after a bend 43. The slider wedge 3 also has a bottom wall 44, which extends away from the back wall 40, perpendicular to the back wall 40 and side walls 41, for a distance twice the length of the top wall 42, viewed from the back wall 40. A short front wall 45, which is parallel to the back wall 40, extends from the bottom wall 44 and at a bending edge 46, transitions into an inclined surface 47 that extends up to the top wall 42 and connects it to the bottom wall 44. Extending along the middle of the longitudinal span of the inclined surface 47, there is a rail 48 that is embodied of one piece and is arrow-shaped in cross section. This arrow-shaped rail 48 thus has a base part 49 extending away from the inclined surface 47 and on top of it, an element 50 that is roof-shaped in cross-section and in the view shown. This roof-shaped element 50 thus forms two sloped roof surfaces 51 with side surfaces 52. Between the side surfaces 52 and each inclined surface 47, a respective groove 53 is formed by the base part 49, the roof-shaped element 50, and the inclined surface 47. The roof-shaped element 50 here has a width that is less than the width of the slider wedge 3.

In the region of the base part 49, an intrinsically known gas compression spring 54 is situated along the length of the cross-sectionally arrow-shaped rail 48 and protrudes beyond the element 48 in the region of the top wall 42.

The cross-sectionally arrow-shaped rail 48—in other words, the roof-shaped element 50 and therefore the sloped roof surfaces 51—has a shape that corresponds to the shape of the opening 16, i.e., the shape of the glide elements 18 and the channel 16, so that when the slider wedge 3 is inserted into the slider bed 2, the surfaces 51 rest against the glide surfaces 18.

When the connector strips 30 are in the mounted position, the beveled surfaces 37 engage in the grooves 53 and rest against the underside of the roof-shaped element 50 in the vicinity of the surfaces 52 so that the slider wedge 3 is secured to the slider bed 2. The beveled surface 37 oriented toward the underside 55 of the roof-shaped element in the region of the groove, in cooperation with the surface 55, forms the second bearing with which, in cooperation with the first bearing formed between the opening 26 and the edge 38, the slider wedge 3 is supported in the slider bed 2. The bearing in this case is embodied as able to move along the bearing lugs in the longitudinal direction and the gas compression spring movably holds the slider wedge in a starting position.

A roof-shaped surface 57 is provided in the bottom wall 44 and extends the length of the bottom surface 44, spaced equidistantly from its lateral edges at the side surfaces 41.

Longitudinal channels 58 are provided in the roof-shaped surface 57, on both sides of an apex point or apex region and corresponding glide elements 59 are inserted into them, each of which protrudes out slightly from the respective channel 58.

In an extension of the side walls 41 approximately in the longitudinal center of the side walls 41, an intrinsically known forced return device protrudes beyond the bottom wall 44, extending the side walls 41 a certain distance beyond the bottom wall and is embodied in the shape of a hook, with a hook leg extending inward, parallel to the bottom wall 44.

The wedge drive 1 also includes the so-called driver 4. The driver 4 is also an oblong box-like component, having a bottom wall 63 serving as a contact area, two end walls 64, 65 that are situated parallel to each other and orthogonal to the bottom wall, and two side walls 66 that extend perpendicular to the bottom wall and end walls.

The driver 4 has a top wall 67 that is inclined relative to the bottom wall 63 and in particular slopes downward slightly, which is embodied as roof-shaped in its longitudinal span, with inclined surfaces 68 sloping downward toward the side walls 66 and is embodied to correspond to the roof-shaped surface 57 in the bottom wall 44 of the slider wedge 3, so that in the assembled state, the surfaces 68 rest against the glide elements 59.

Approximately in the transverse center of the side walls 66 there is a projection 69 pointing outward, which is adjacent to the edge shared by the side walls 66 and top wall 67 and is embodied so that it cooperates with the forced return device 60 in such a way that with a movement of the slider wedge 3 on the driver 4 that causes the slider wedge 3 to travel downward along the inclination, the forced return device 60 embraces the projection 69 and thus couples the slider wedge to the driver so that they cannot be pulled apart from each other. The coupling occurs in compulsory fashion until the slider has executed its return stroke. Only then does the coupling open.

The bottom wall 63 of the driver 4 is also provided with screw holes 70 and dowel holes for a bottom part 71. This allows the slider bed 2 to be fastened to the top part of a tool and the driver to be fastened to the bottom part of a tool while the driver wedge 3 is able to move along the glide elements 18 and along the glide elements 59.

An essential feature of the invention is the fact that the slider wedge 3 is secured to the slider bed 2 by means of the connector strips 30; according to the invention, the movable coupling is produced by the fact that the groove 53 transitions into the bearing lugs 36 and the bearing lugs 36 in turn are supported in openings in the side wall 7 of the slider bed 2. As a result, as opposed to wedge drives with brackets, the distance between the different force introduction points—in the invention these are the first and second bearings—is greatly reduced so that very narrow tolerances are possible and heat-induced stresses have significantly less impact.

In addition, this embodiment according to the invention also enables an increased stability and rigidity of a wedge drive.

It is also advantageous that the use of bearing bronze, which is relatively expensive compared to the casting material, is reduced and in addition, depending on the design of the connector strip and the beveled surfaces 37 of the connector strips 30, the connector strips can not only be advanced in the longitudinal direction, but can also be swapped right to left and vice versa since this permits utilization of their "unworn" beveled surfaces 37. In order to do this, however, the connector strips must be symmetrically embodied.

Figure 18:
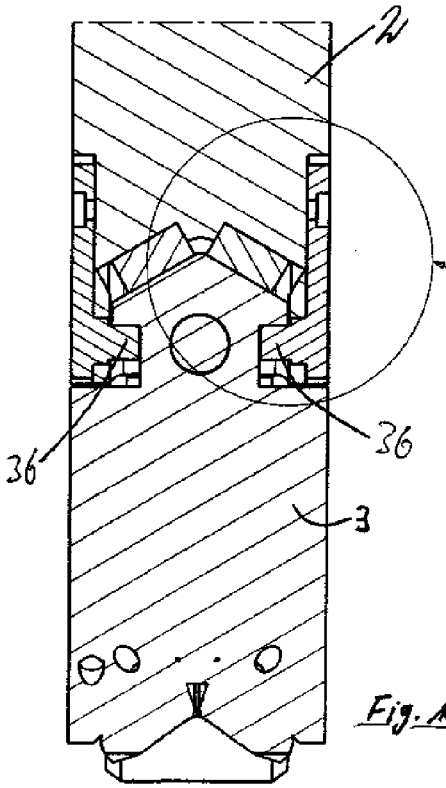
FIG. 18 shows a cross-section through the wedge drive from FIG. 17 along the sectional plane A-A.
Figure 19:
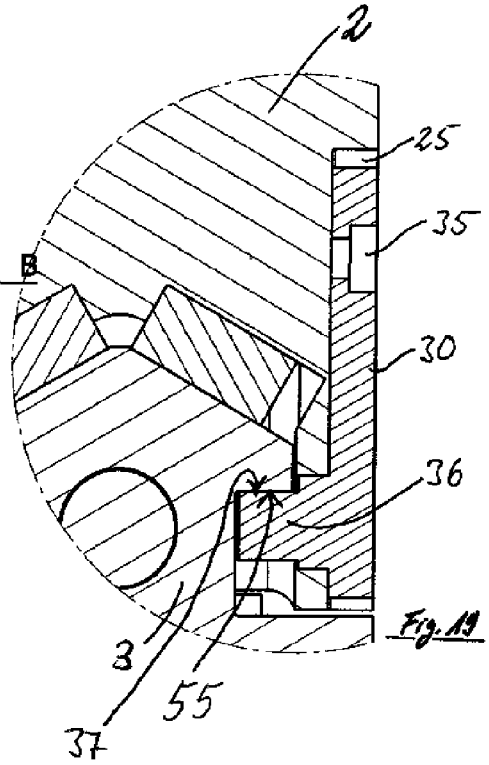
FIG. 19 shows an enlarged detail from FIG. 18.
Figure 20:
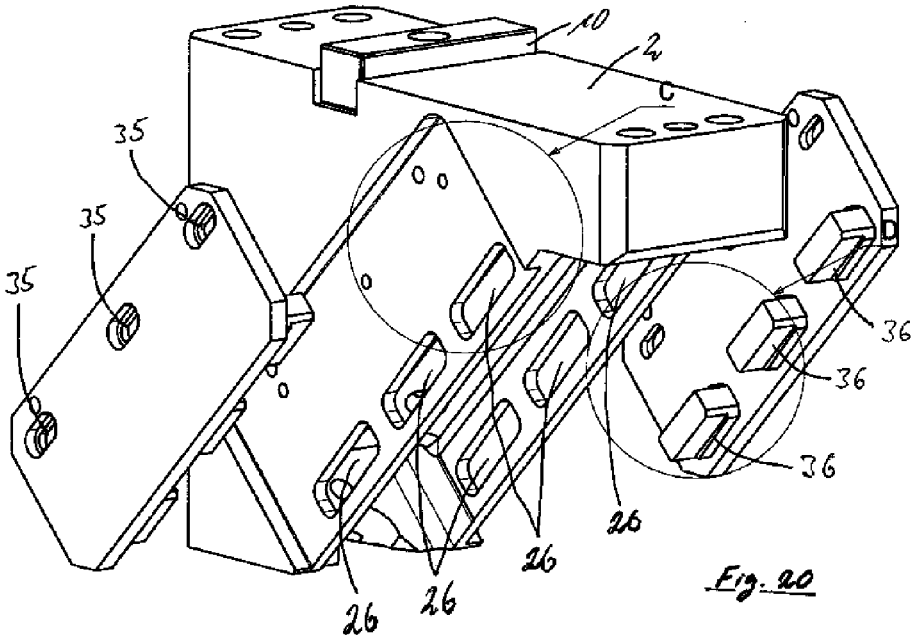
FIG. 20 shows the wedge drive from FIG. 13 in a perspective exploded view of the slider bed and the connector strips.
Figure 21:
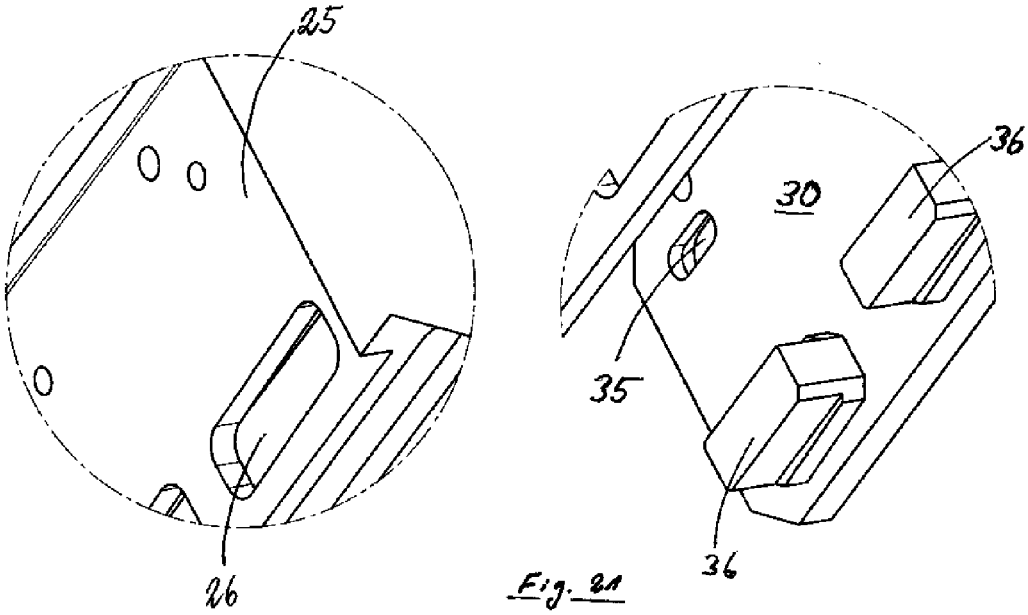
FIG. 21 shows enlarged details from FIG. 20.
Figure 22:
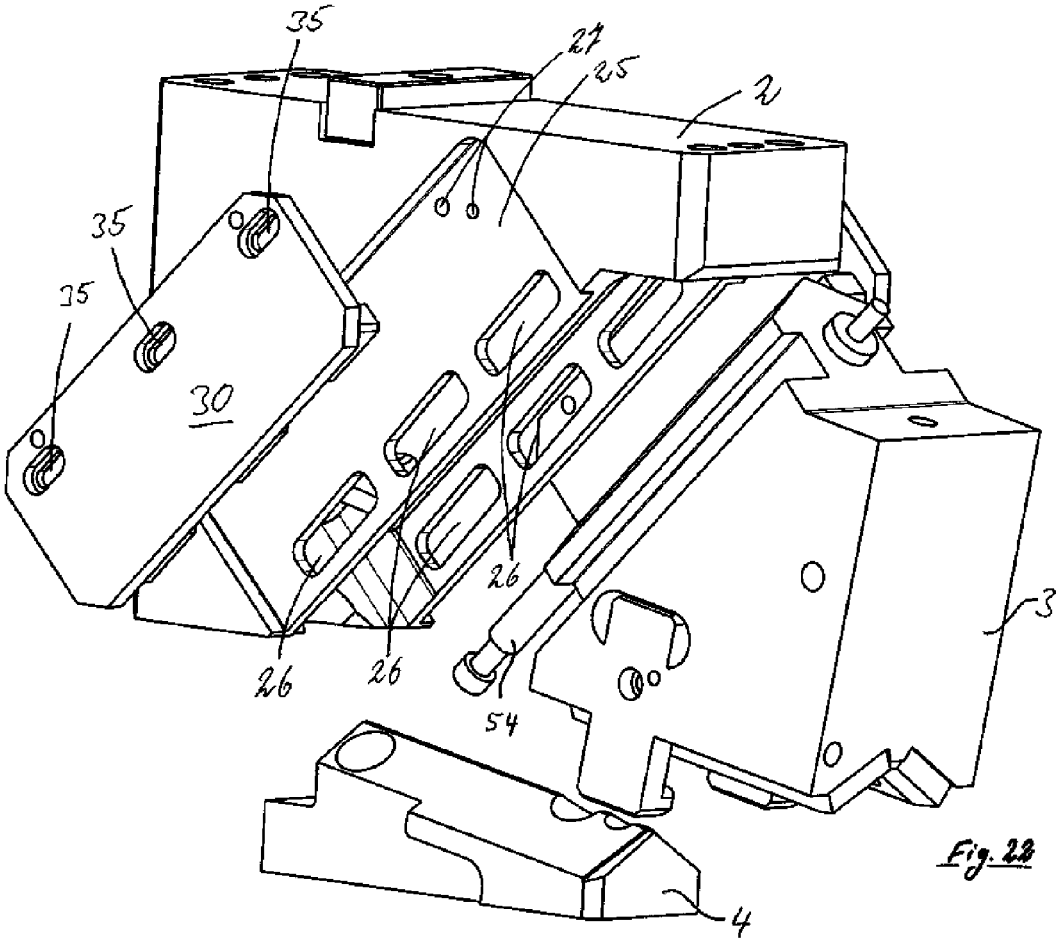
FIG. 22 is a perspective exploded view of the wedge drive from FIG. 13, including the slider, the driver, the slider bed, and the associated connector strips.
Figure 23:
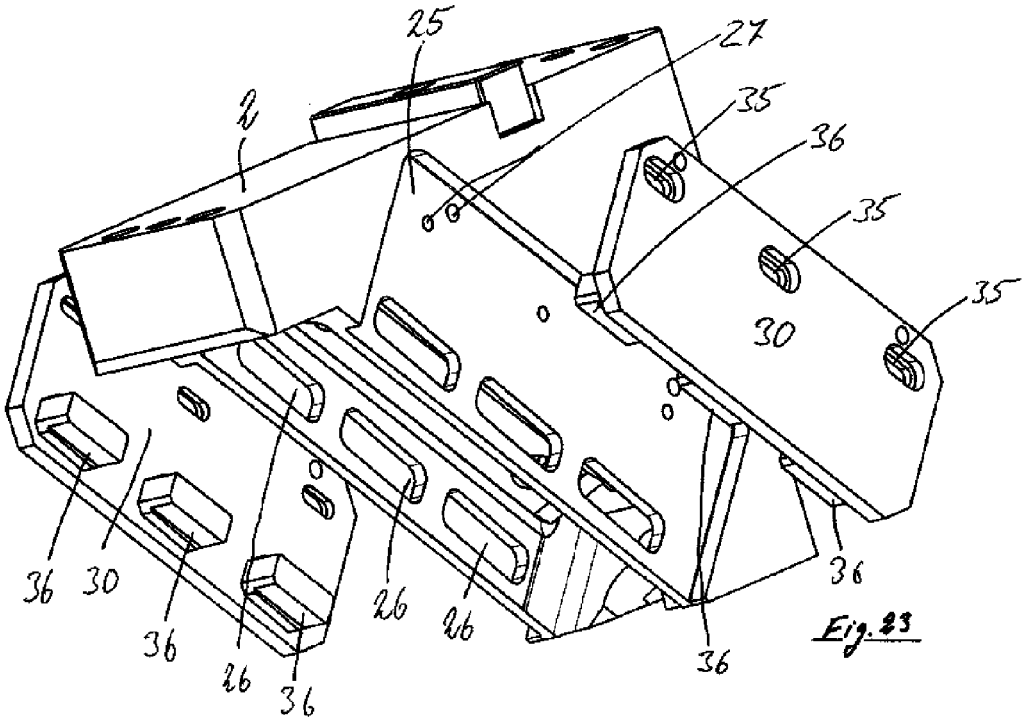
FIG. 23 is another exploded view of the wedge drive from FIG. 13, with the associated connector strips and the slider bed.
Figure 24:
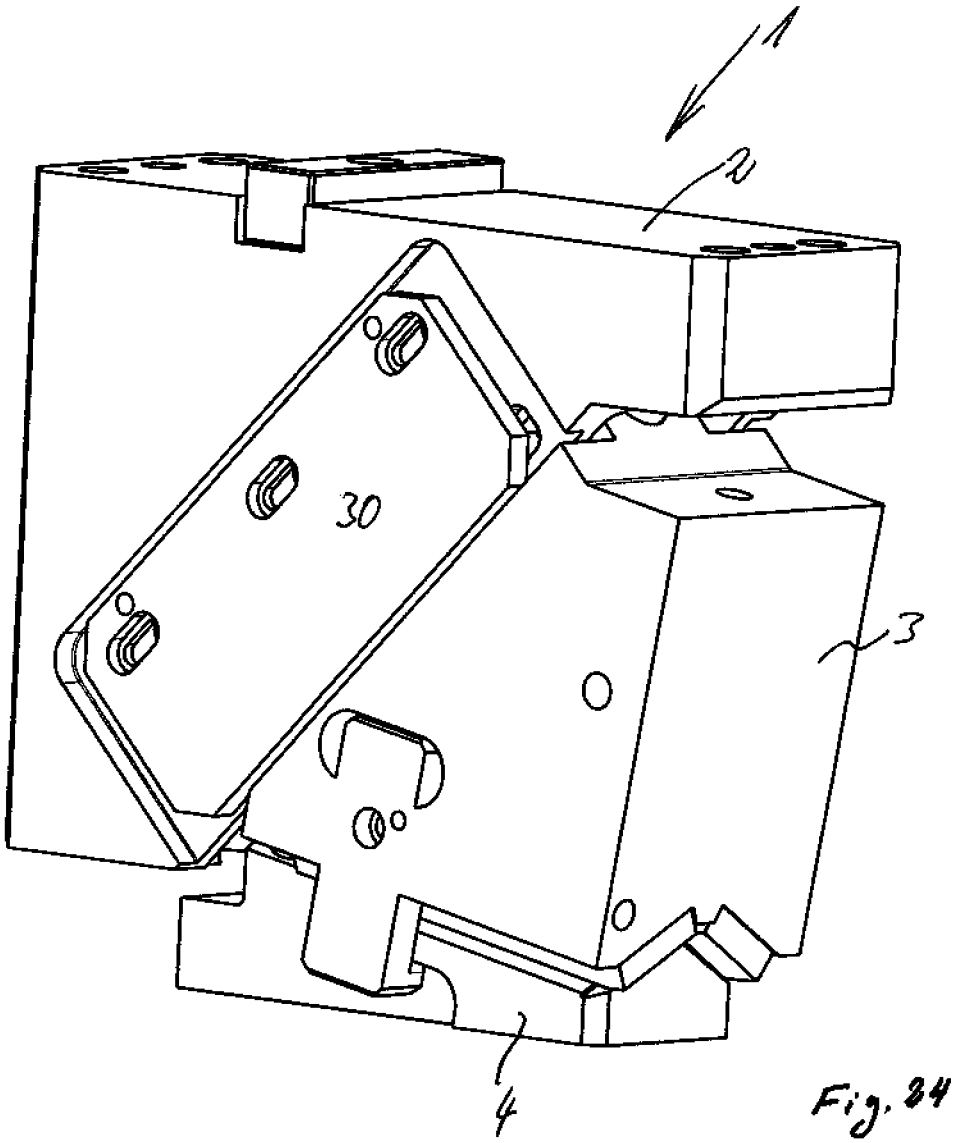
FIG. 24 is a perspective view of the wedge drive from FIG. 13.
Figure 25:
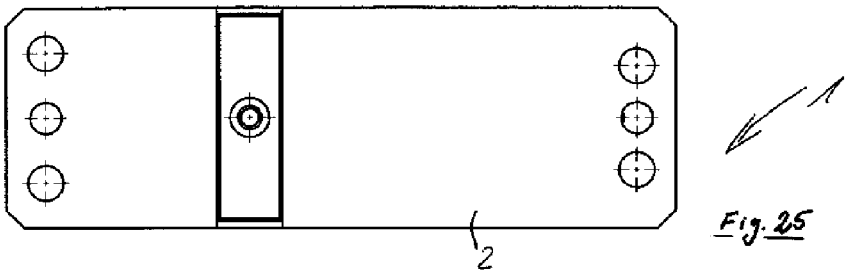
FIG. 25 is a top view of another embodiment of the wedge drive according to the invention.
Figure 26:
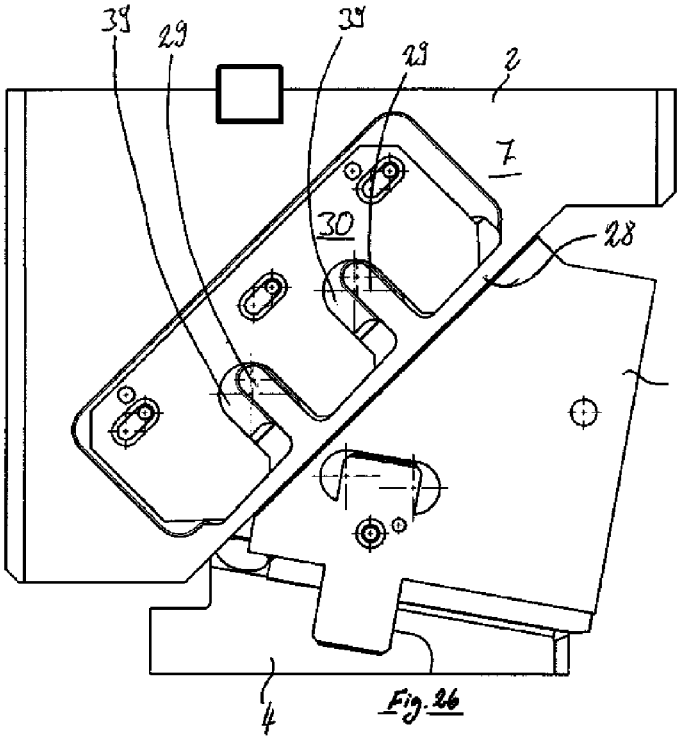
FIG. 26 is a side view of the wedge drive from FIG. 25.
Figure 27:
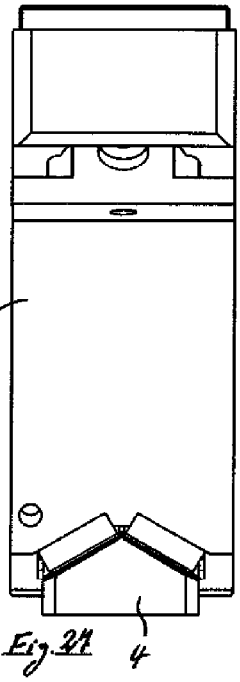
FIG. 27 is a front view of the wedge drive from FIG. 25.
Figure 28:
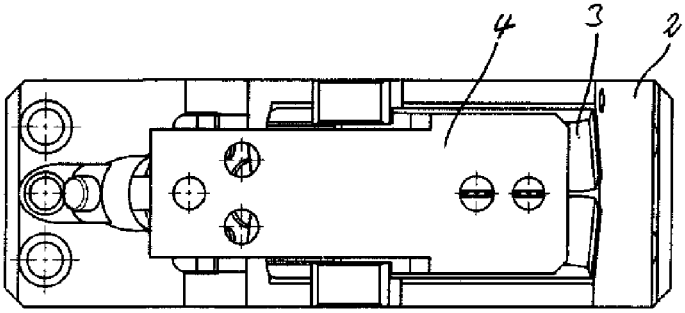
FIG. 28 is a bottom view of the wedge drive from FIG. 25.
Figure 29:
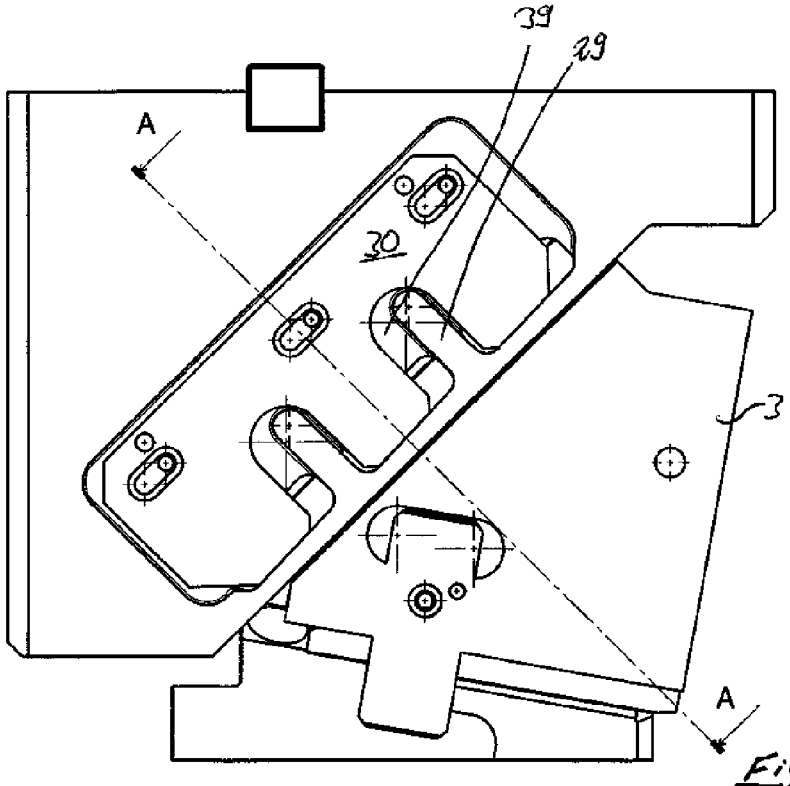
FIG. 29 is a side view of the wedge drive from FIG. 25, with a sectional plane indicated.
Figure 30:
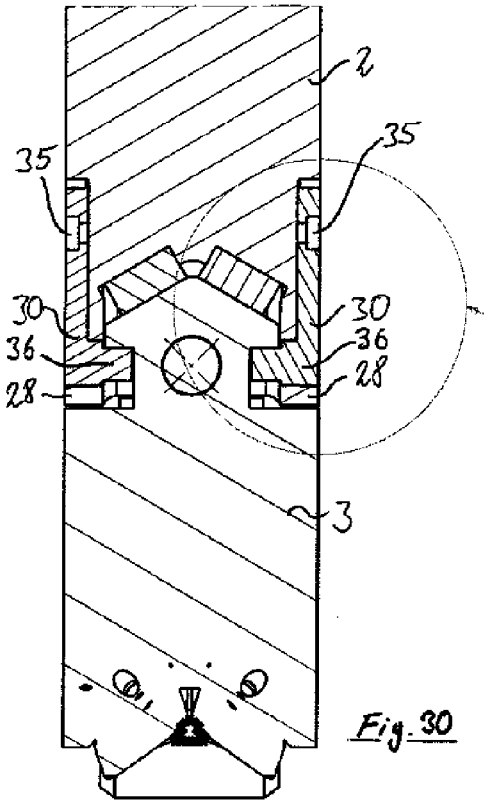
FIG. 30 shows a cross-section through the wedge drive from FIG. 29 along the sectional plane A-A.
Figure 31:
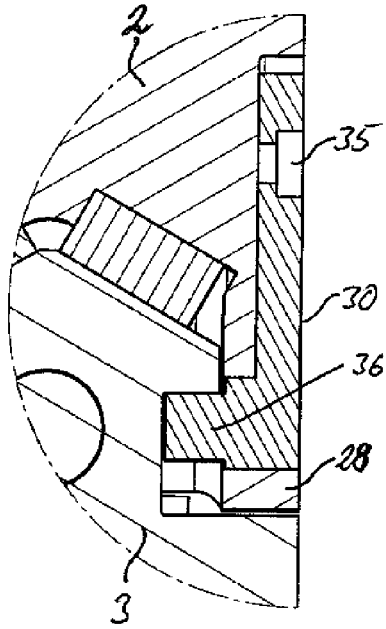
FIG. 31 shows an enlarged detail from FIG. 30.
Figure 34:
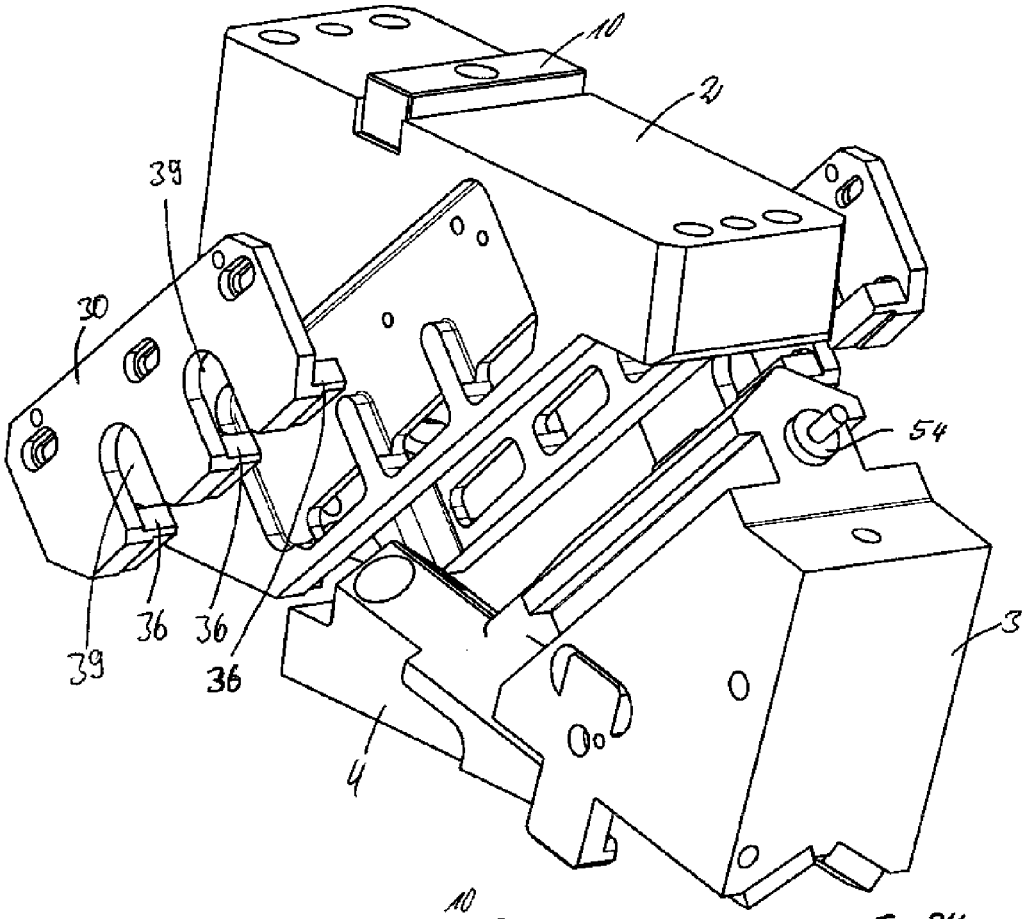
FIG. 34 is a perspective exploded view of the wedge drive from FIG. 25, showing the slider, the driver, the slider bed, and the connector strips.
Figure 35:
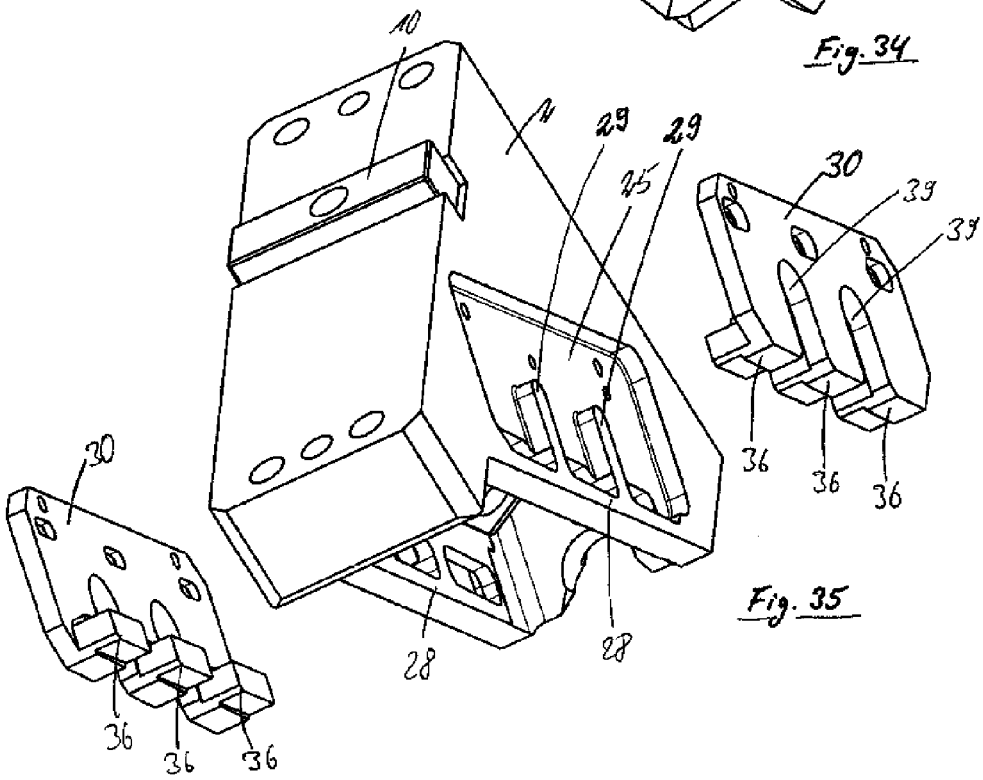
FIG. 35 shows the wedge drive from FIG. 25 in another perspective exploded view of the slider bed and the associated connector strips.
Figure 36:
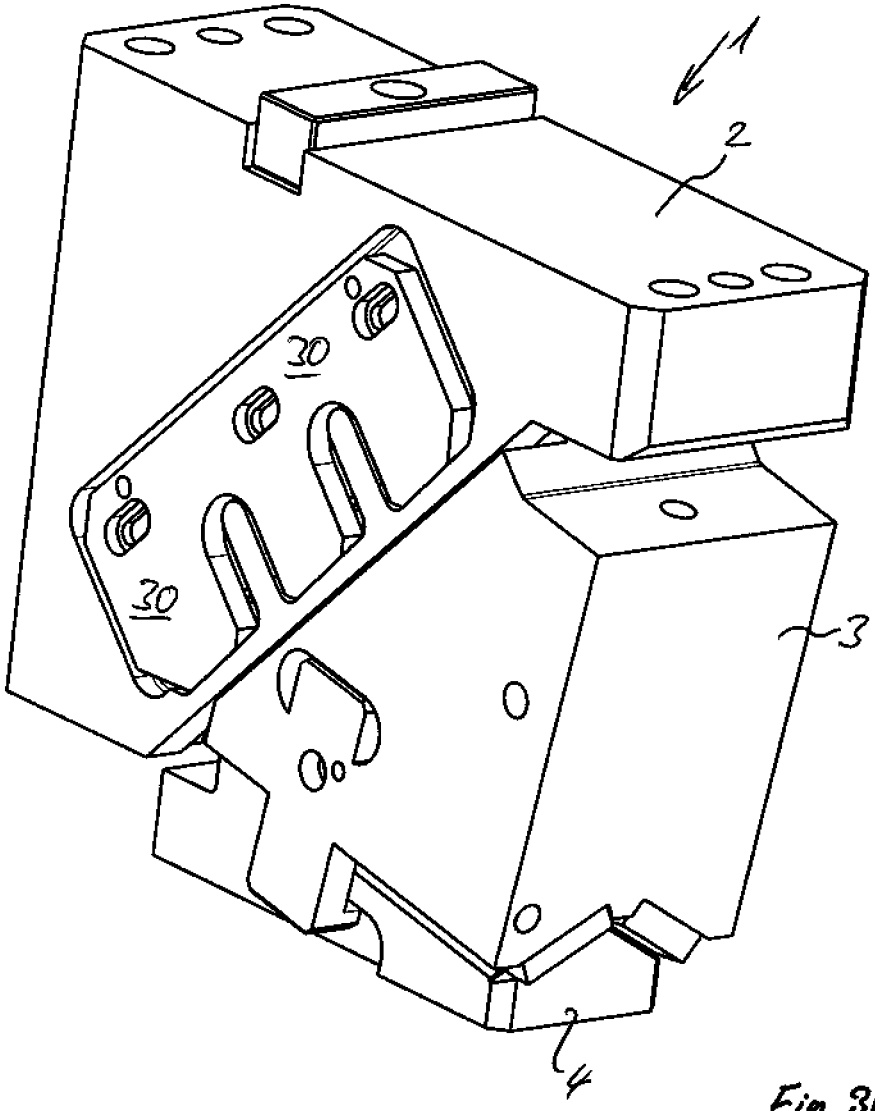
FIG. 36 is a perspective view of the wedge drive from FIG. 25.
Figure 37:
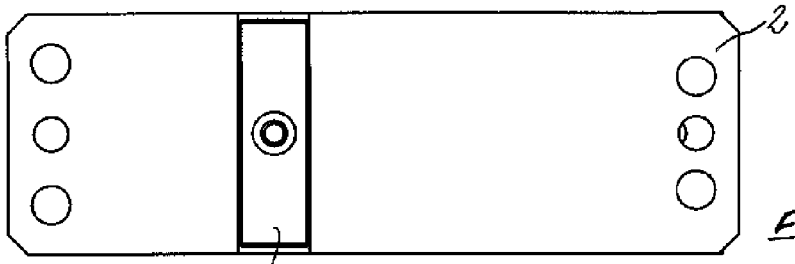
FIG. 37 is a top view of another embodiment of the wedge drive.
Figure 38:
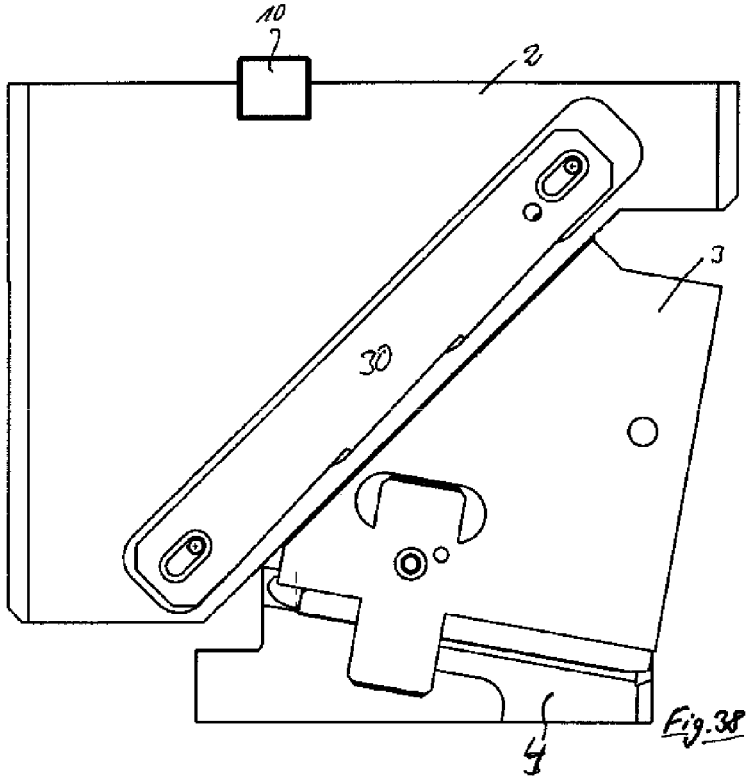
FIG. 38 is a side view of the wedge drive from FIG. 37.
Figure 39:
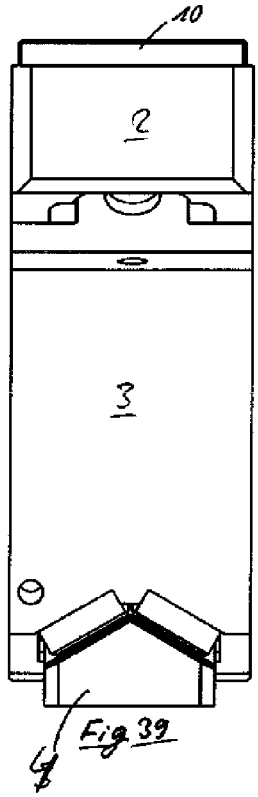
FIG. 39 is a front view of the wedge drive from FIG. 37.
Figure 40:
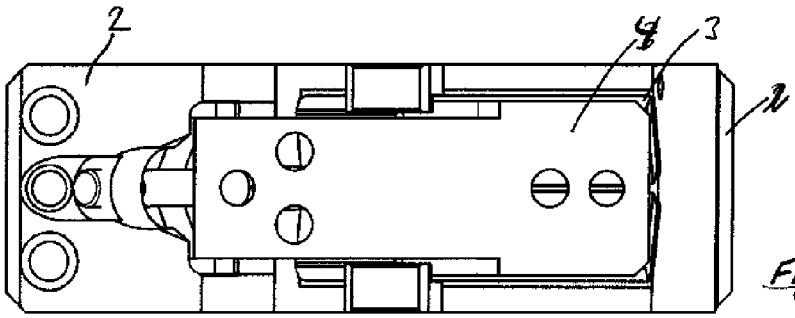
FIG. 40 is a bottom view of the wedge drive from FIG. 37.
Figure 41:
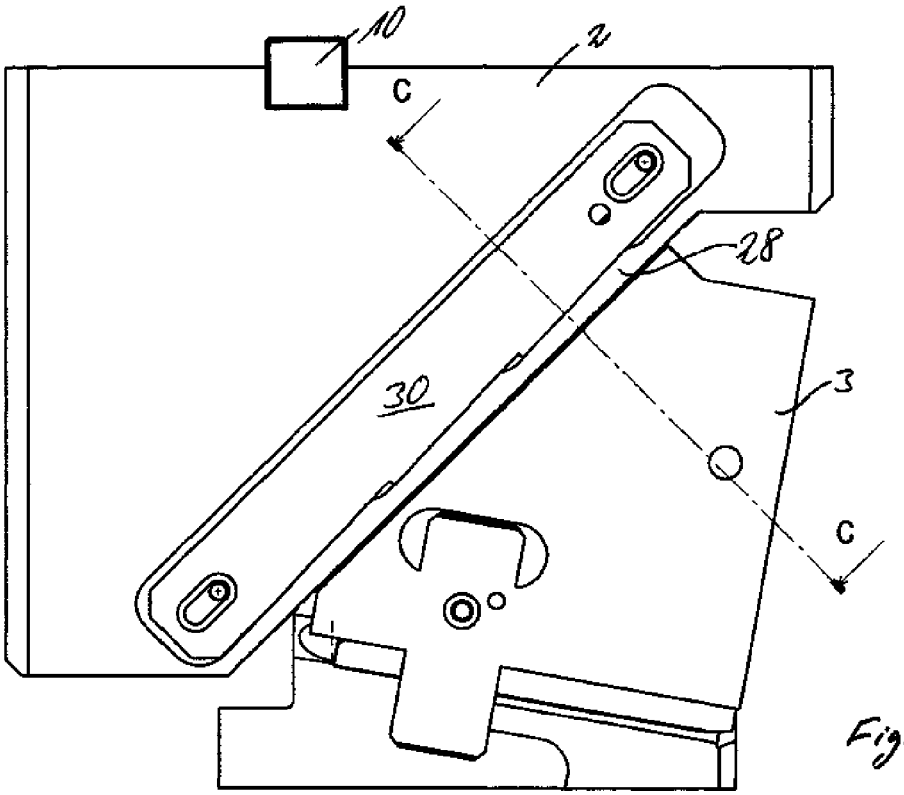
FIG. 41 shows the wedge drive from FIG. 37, with a sectional plane indicated.

In another advantageous embodiment (FIGS. 13 to 24), the channel 25 is embodied as widened; the mounting holes 35 of the connector strip 30 are positioned laterally offset relative to the bearing lugs 36 and in cross-section, the connector strips 30 with the bearing lugs 36 constitute an approximately L-shaped cross-section (FIGS. 18 and 19).

The function of the bearing lugs 36 themselves, however, is the same as in the previous embodiment; only the fastening points of the connector strips 30 to the slider bed 2 are shifted out of the region of the opening 16 into the solid part of the slider bed 2. Otherwise, the description of the first embodiment applies here as well.

In another advantageous embodiment (FIGS. 25 to 36), the functions are essentially the same as in the previous embodiments, so the description of them applies here as well, except for the following differences.

In this embodiment, next to the openings 26 and between the openings 26 and the free edge 14 of the side wall 7, the channel 25 is delimited by a rim 28 and in this region, the side wall 7 has its full thickness. Between each pair of openings 26, a respective rib 29 extends from the rim 28 toward the interior of the channel 25; in the region of these ribs 29, the wall material likewise has the same wall thickness as the side wall 7 in the region of the opening 16. This offers improved stability to the force absorbing region, in particular of the first bearing.

In order to be able to place a corresponding connector strip 30 here, the connector strip 30 is embodied as wider than the ribs 29 are long and in particular, has the same basic shape as in the previously described embodiment. The cut-outs 39 in the connector strip 30 for accommodating the ribs 29 are in particular embodied as slightly deeper and slightly wider than the ribs 29 so as to permit the connector strip 30 to move in the longitudinal direction despite the presence of the ribs 29.

In this embodiment, the region between the bearing openings 26 in particular is reinforced by the material of which the slider bed 2 is composed.

In another advantageous embodiment (FIGS. 41 to 50), the basic parts and their functions are essentially identical, but in this case, a wear compensation of the glide surfaces between the slider bed 2 and slider wedge 3 and between the surfaces 37 of the connector strip and surfaces 55 of the slider wedge is produced not by the fact that the wear compensation is provided by the beveled surfaces 37 of the lugs 36 on the one hand and the shifting of the connector strip 30 on the other, but rather by the fact that the entire connector strip is shifted in its orientation relative to the side walls 7 so that the lugs 36 are moved toward the surfaces 55 of the slider wedge 3.

In this embodiment a rim 28 is provided; the edge 14 of the rim 28 oriented toward the channel does not extend parallel to the edge 14, but rather has slopes **28*b* in the region of the openings 26, which slope downward via steps 28***a* to the next slope 28*b* in the region of the next bearing opening 26.

The connector strip 30 has corresponding sloped surfaces 33*b* extending along a longitudinal edge 33*b*, which slope down to the next slope via steps 33*a*, which face the steps 28*a* in the assembled state.

The bearing openings 26 are likewise tilted slightly relative to the edge 14 in accordance with the slope of the sloped regions 28*b* so that when the connector strip 30 is shifted, the lugs 36 are shifted closer to the roof-shaped surface 16 in accordance with the slopes, which when the slider wedge 3 is in the mounted state, compensates for play resulting from wear.

The surfaces 37 of the lugs 36 here can likewise be beveled in accordance with the orientation of the sloped regions 28*b*, thus increasing the movement of the lugs 36 toward the roof-shaped surface 16. Alternatively, the beveled surfaces 37 can also be embodied so that the bevels extend in the opposite direction from the slope of the surfaces 28*b* so that a larger portion of the surfaces 37, in particular their entire area, rests against the surfaces 55.

This in turn means that it is possible to further reduce the wear between the surfaces 37 and 55 through full-surface contact.

Figure 42:
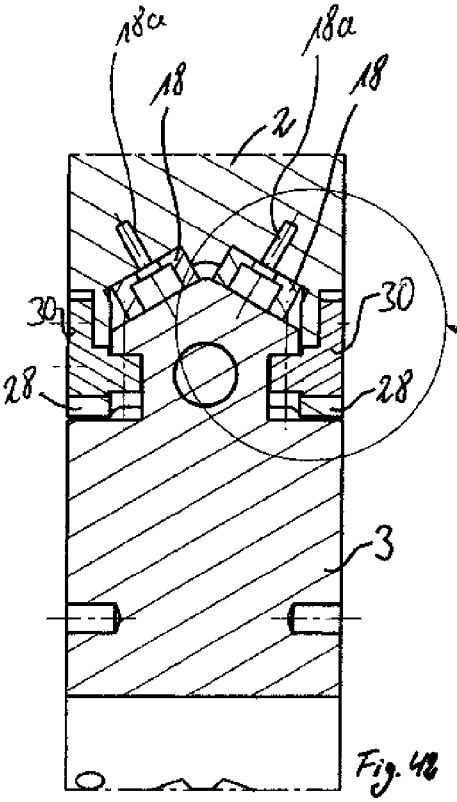
FIG. 42 is a cross-section through the wedge drive from FIG. 41 along the sectional plane C-C.
Figure 43:
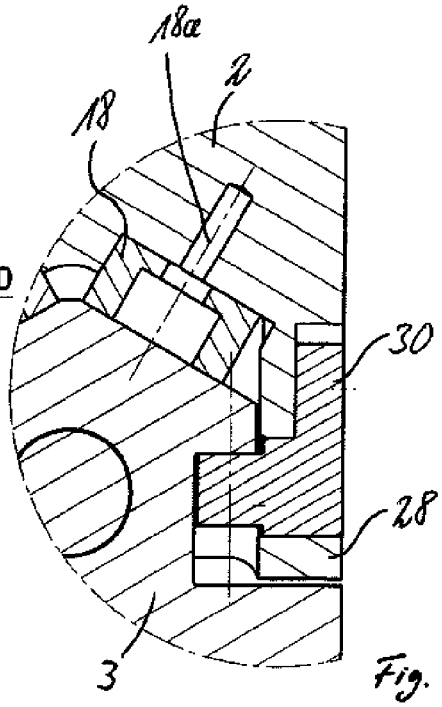
FIG. 43 shows an enlarged detail from FIG. 42.
Figure 44:
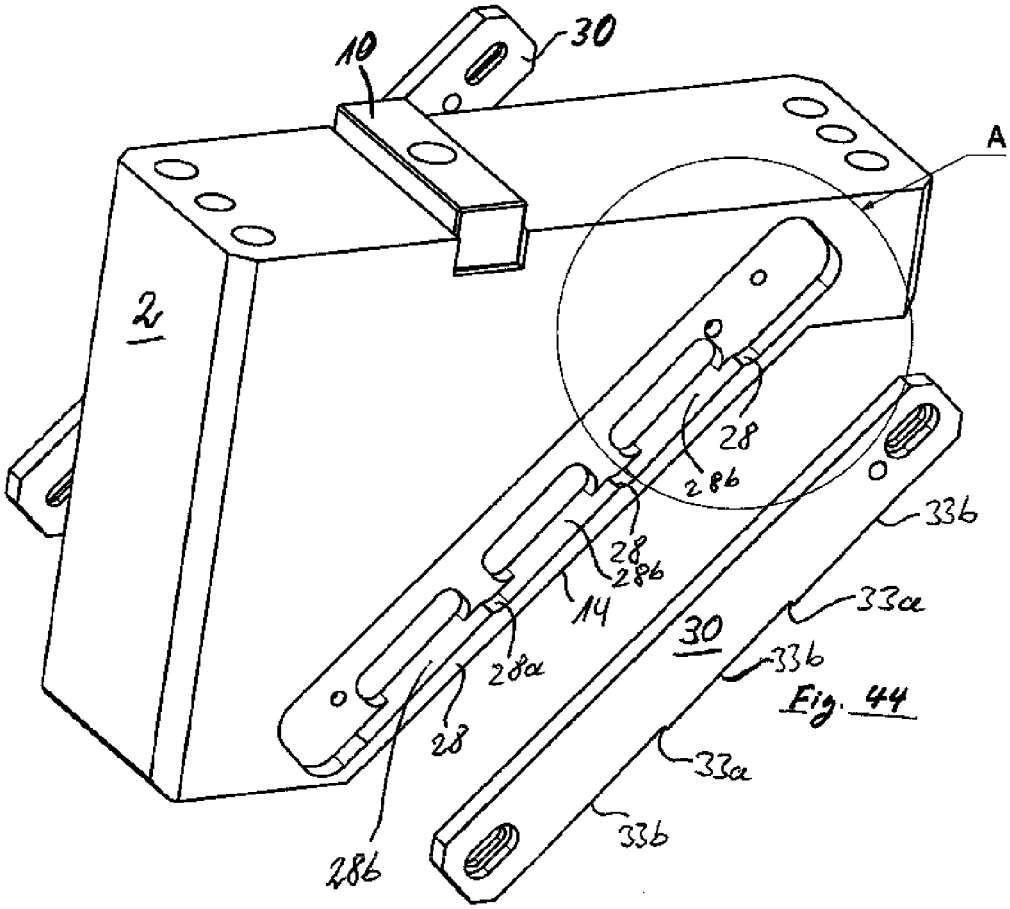
FIG. 44 shows the wedge drive from FIG. 42 in a perspective exploded view of the slider bed with the connector strips.
Figure 45:
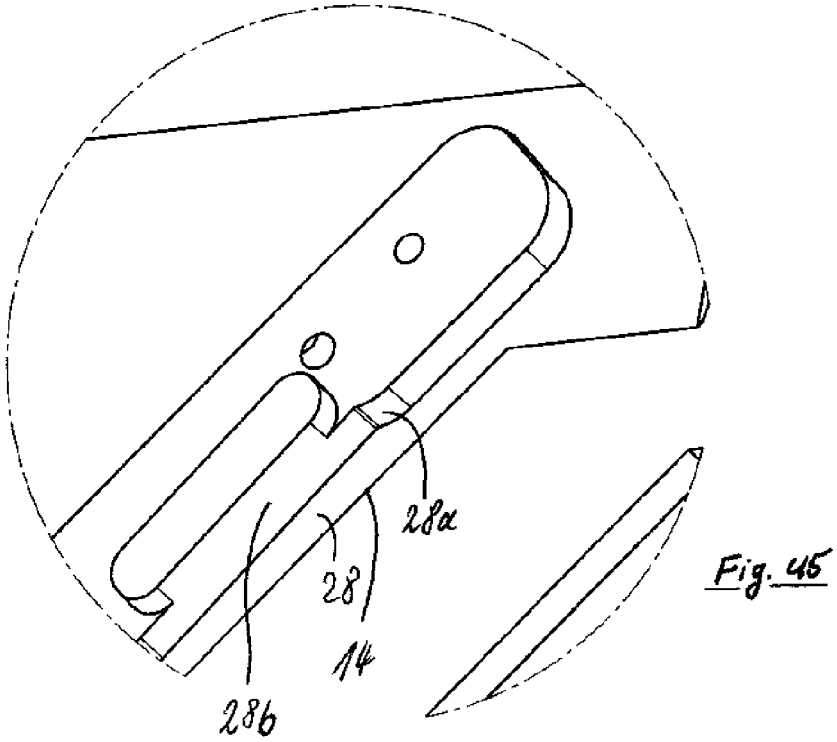
FIG. 45 shows an enlarged detail from FIG. 44.
Figure 46:
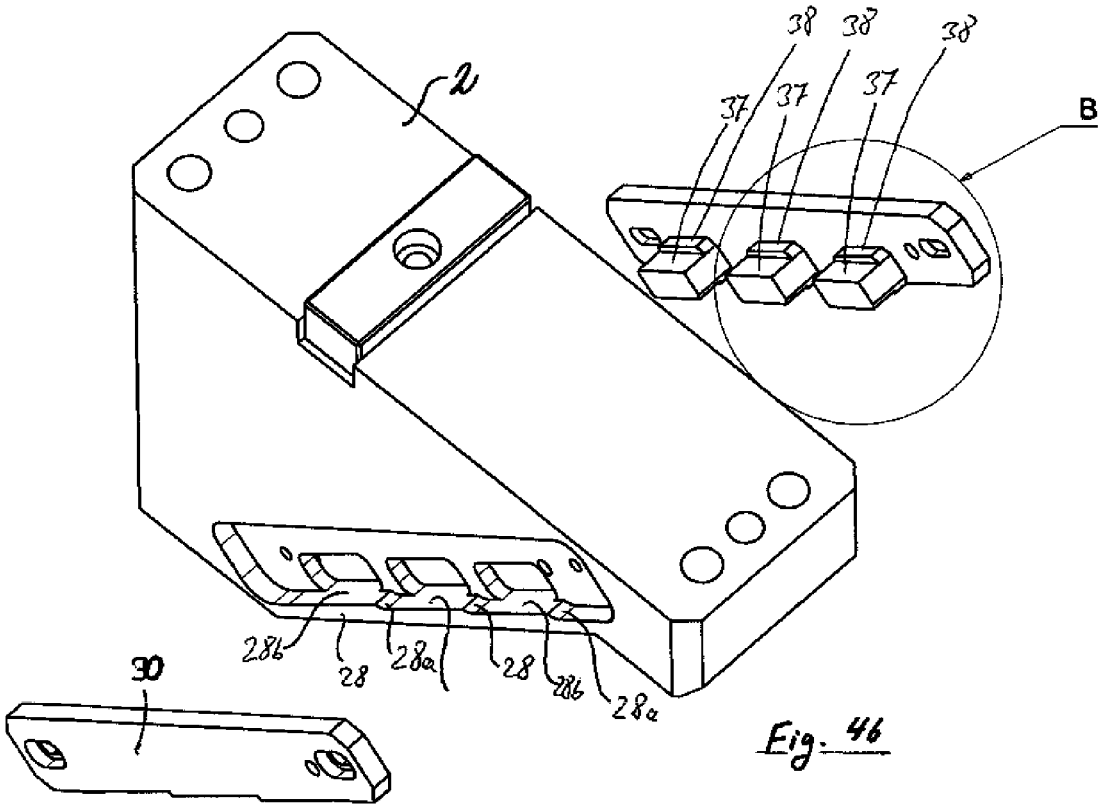
FIG. 46 is another exploded view of the wedge drive from FIG. 37, with the slider bed and the associated connector strips.
Figure 47:
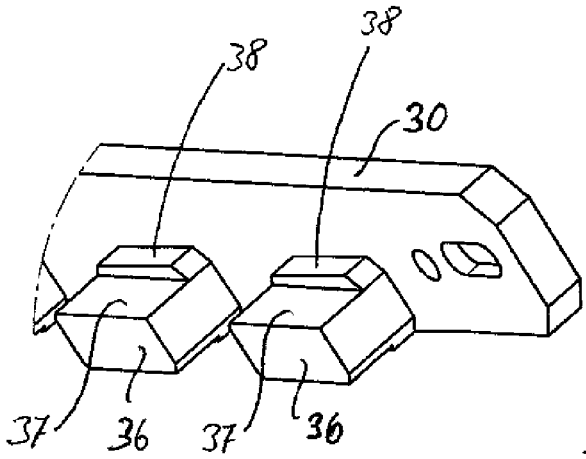
FIG. 47 shows an enlarged detail from FIG. 46.
Figure 48:
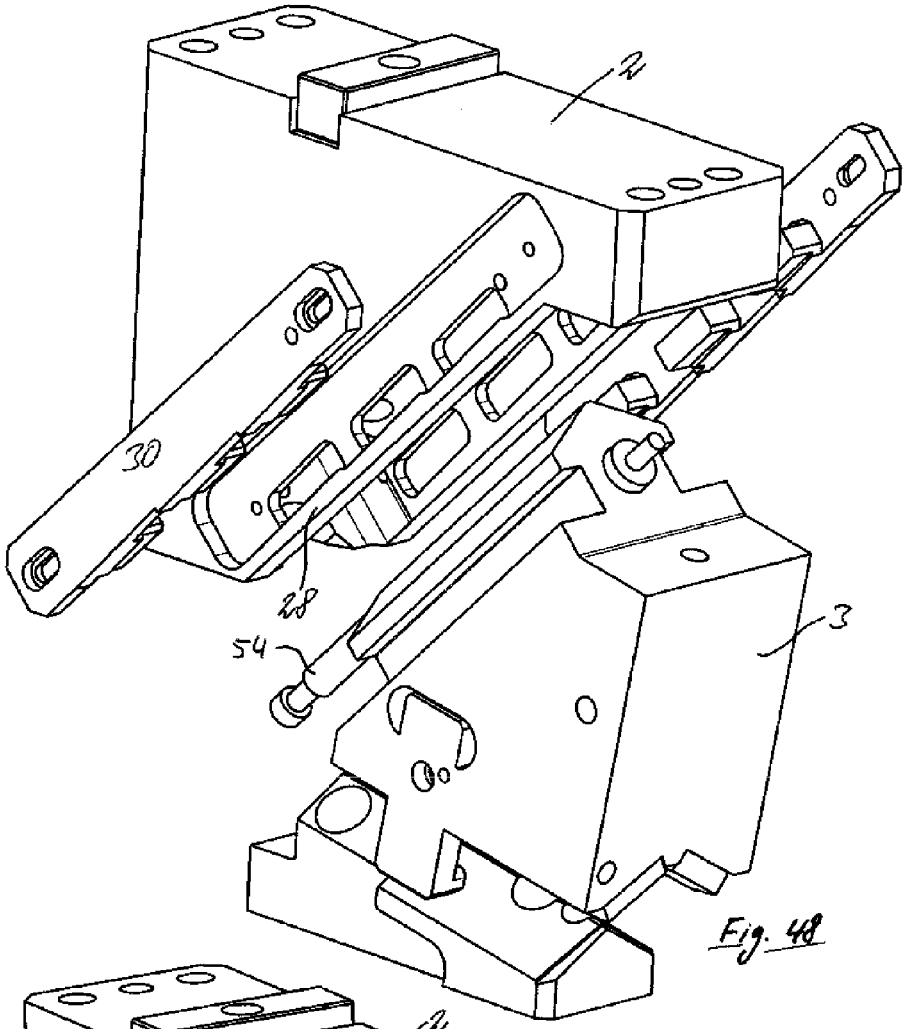
FIG. 48 shows the wedge drive from FIG. 37 in an exploded view showing the slider, the driver, the slider bed, and the associated connector strips.
Figure 49:
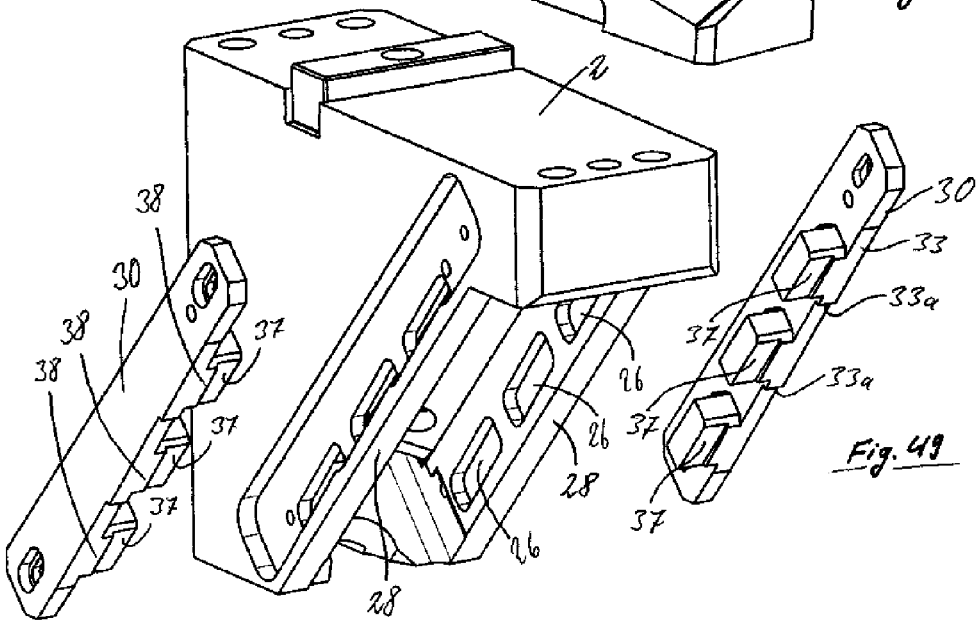
FIG. 49 is another exploded view of the wedge drive from FIG. 37 showing the slider bed and the associated connector strips.
Figure 50:
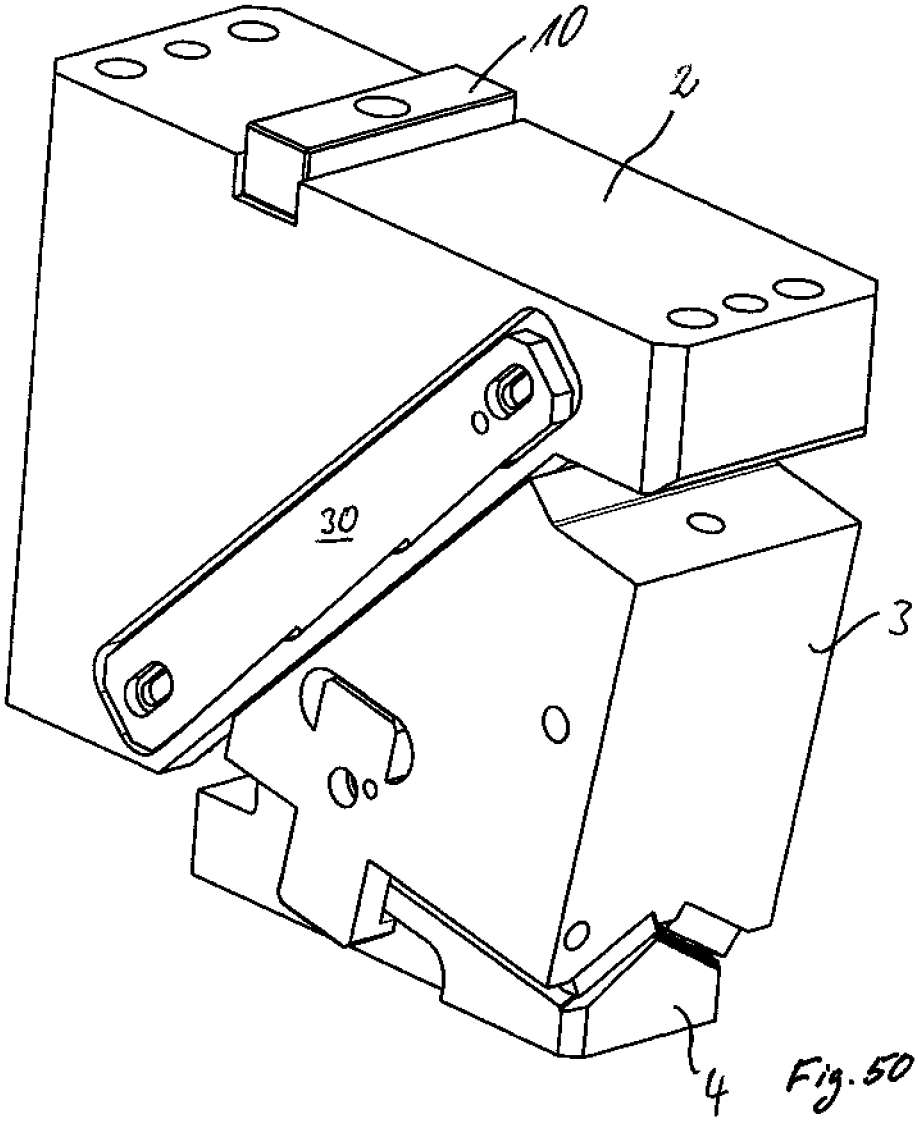
FIG. 50 is a perspective view of the wedge drive from FIG. 37.
Figure 51:
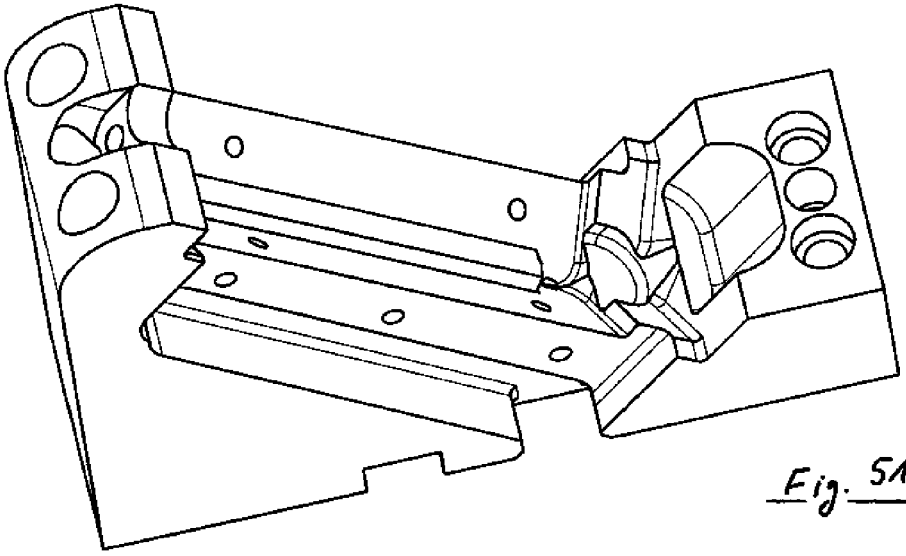
FIG. 51 shows a slider bed according to the prior art for use with brackets.
Figure 52:
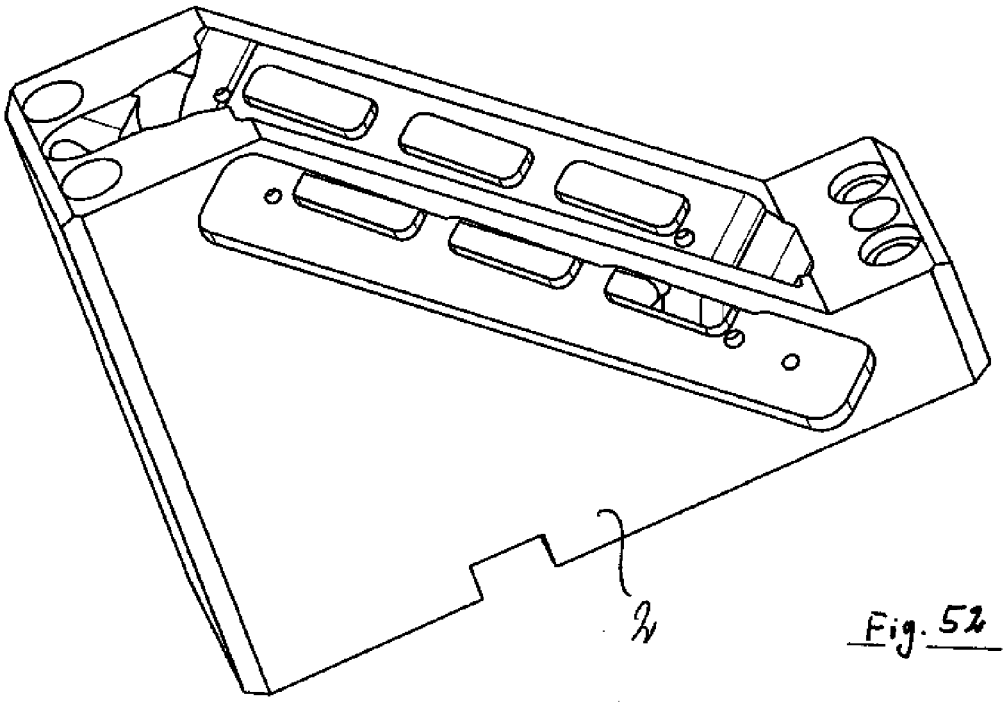
FIG. 52 shows a slider bed according to the invention.
Figure 53:
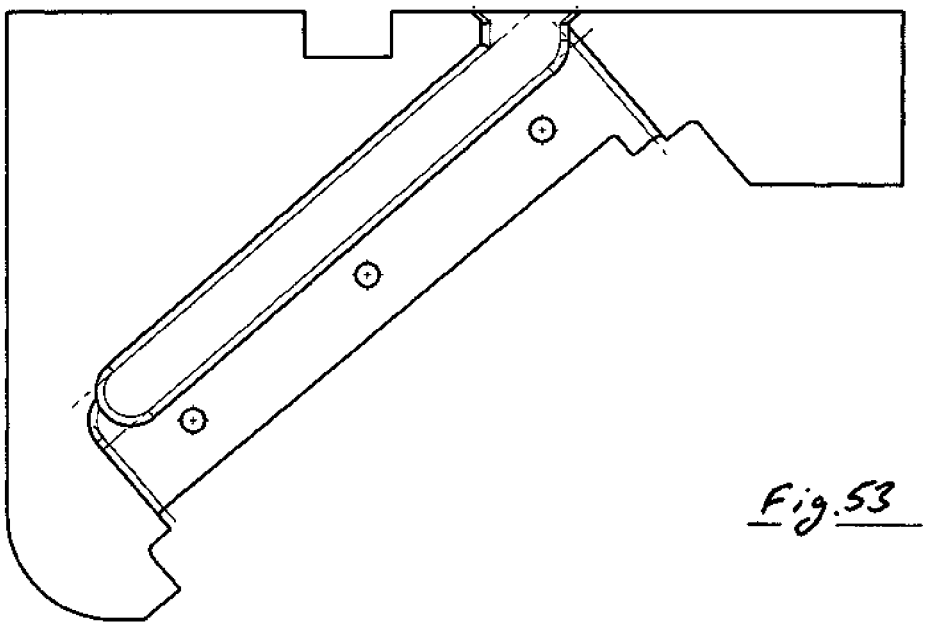
FIG. 53 is a side view of a slider bed according to the prior art.
Figure 54:
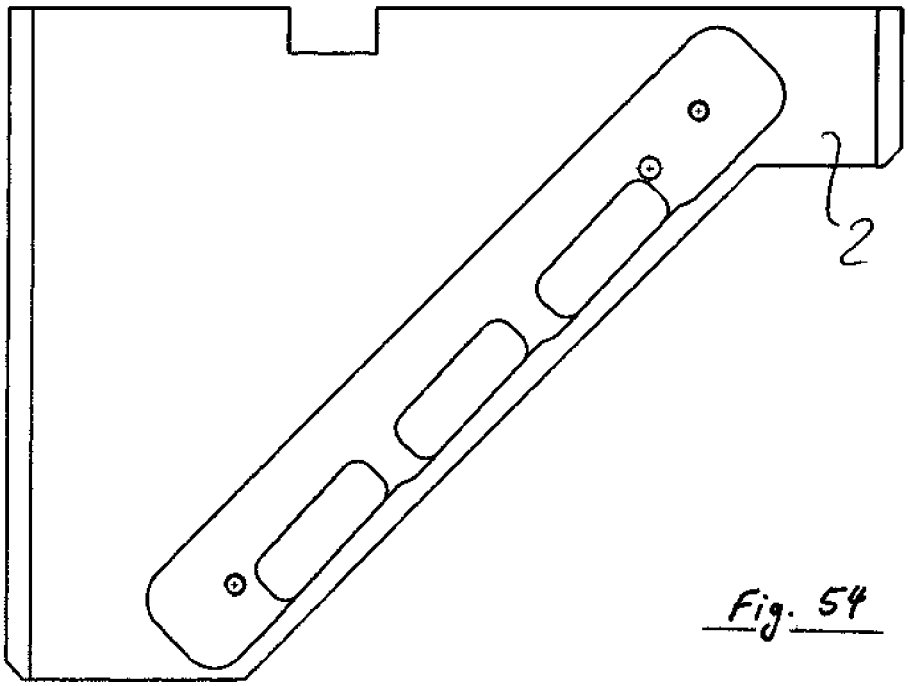
FIG. 54 is a side view of a slider bed according to the invention.

As is clear from FIGS. 42 and 43, the glide elements 18 are secured in the corresponding channels by means of screw connections; corresponding threaded holes 18*a* are provided in the slider bed 2.

In all of the embodiments, the slider bed 2 can be provided with set screws, which by being screwed in along the longitudinal direction of the connector strips 30 and acting on an edge at the end of the connector strips 30, are able to shift the connector strips 30; the connector strips 30 can be immobilized on the slider bed 2 by means of bolts that are screwed through the oblong holes 35 into the mounting holes 27. To take the strain off of the set screw (not shown) provided for shifting the connector strips 30 and/or to make it easier to immobilize the connector strips in the mounted state, the inside of the connector strip can be provided with a fine denticulation or ribbing or a comparable surface treatment in order to significantly increase the sliding friction after the tightening of the mounting screws; naturally, the channel bottom can also have a corresponding surface treatment.

The advantages of the invention as compared to the prior art with regard to the slider bed 2 are also evident in FIGS. 51 to 54. In a conventional bracket slider, the slider bed is embodied as relatively open; a bracket is placed against the side and engages in claw fashion in the grooves of the slider wedge. This bracket is in turn screwed to the slider bed.

In the slider bed 2 according to the invention (FIGS. 52 to 54), the side walls 7 are extended far beyond the roof-shaped surface of the slider bed 2 and serve as a guide of the slider wedge 3; because the extended side walls are composed of the very stable material of the slider bed 2, this achieves a high level of stability. The function of the connector strips 30 can therefore be reduced to the actual purpose, namely pressing and holding the slider wedge 3 against the slider bed 2, which also entails a significantly reduced consumption of bearing bronze.

Even though the invention has been explained on the basis of an overhead suspension slider, it is not limited to this. The invention can naturally also be successfully used on sliders with a traveling support at the bottom.

The invention claimed is:

1. A wedge drive for converting a vertical pressing force, the wedge drive comprising:

at least one slider bed;

one slider wedge;

one driver; and at least one bearing lug that provides a movable coupling of the slider wedge in the slider bed;

wherein the at least one bearing lug reaches through at least one bearing opening in a side wall of the slider bed from outside the slider bed and engages in a recess in the slider wedge;

the slider wedge is supported on the bearing lug and the bearing lug is supported on a wall delimiting the bearing opening.

2. The wedge drive as recited in claim 1, further comprising a plurality of bearing lugs situated on a plate-like connector strip, wherein the connector strip is situated resting against an outside of a side wall and the bearing lugs each reach through a respective bearing opening and protrude inward into an opening of the slider bed into which the slider wedge extends, and engage in a bearing groove of the slider wedge.

3. The wedge drive as recited in claim 1, comprising two connector strips that engage in diametrically opposing fashion in bearing grooves of the slider wedge situated on opposing side walls.

4. The wedge drive as recited in claim 1, wherein the bearing lugs are arranged in longitudinally movable fashion in the bearing openings.

5. The wedge drive as recited in claim 1, wherein on opposite sides facing away from each other, the bearing lugs have first bearing surfaces, which rest against walls of the bearing openings, and second bearing surfaces for supporting the slider wedge are also provided directly adjacent to these first bearing surfaces, on opposite sides of the bearing lugs facing away from each other.

6. The wedge drive as recited in claim 5, wherein the first bearing surfaces are oriented parallel to each other, the second bearing surfaces are oriented parallel to each other, and adjacent first and second bearing surfaces are situated at an angle to each other.

* * * * *